US008292694B2

(12) United States Patent
Togawa et al.

(10) Patent No.: US 8,292,694 B2
(45) Date of Patent: Oct. 23, 2012

(54) SUBSTRATE HOLDING MECHANISM, SUBSTRATE POLISHING APPARATUS AND SUBSTRATE POLISHING METHOD

(75) Inventors: Tetsuji Togawa, Chigasaki (JP); Toshio Watanabe, Tokyo (JP); Hiroyuki Yano, Yokohama (JP); Gen Toyota, Yokohama (JP); Kenji Iwade, Hiratsuka (JP); Yoshikuni Tateyama, Oita (JP)

(73) Assignees: Ebara Corporation, Tokyo (JP); Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 12/618,033

(22) Filed: Nov. 13, 2009

(65) Prior Publication Data

US 2010/0062691 A1 Mar. 11, 2010

Related U.S. Application Data

(62) Division of application No. 12/184,032, filed on Jul. 31, 2008, now Pat. No. 7,883,394, which is a division of application No. 10/539,245, filed as application No. PCT/JP03/17032 on Dec. 26, 2003, now Pat. No. 7,419,420.

(30) Foreign Application Priority Data

Dec. 27, 2002 (JP) ..... 2002-380583
Jun. 30, 2003 (JP) ..... 2003-188775

(51) Int. Cl.
*B24B 49/00* (2012.01)

(52) U.S. Cl. ..... 451/7; 451/53

(58) Field of Classification Search ..... 451/7, 41, 451/53, 285–290

See application file for complete search history.

(56) References Cited

U.S. PATENT DOCUMENTS 2,182,952 A 12/1939 Guerin et al.
(Continued)

FOREIGN PATENT DOCUMENTS

EP 0 776 730 A1 6/1997
(Continued)

OTHER PUBLICATIONS

English translation of an Office Action issued Sep. 18, 2009 in Chinese Application No. 2008101255002.

(Continued)

*Primary Examiner* — Maurina Rachuba
(74) *Attorney, Agent, or Firm* — Wenderoth, Lind & Ponack, L.L.P.

(57) ABSTRACT

A substrate holding mechanism, a substrate polishing apparatus and a substrate polishing method have functions capable of minimizing an amount of heat generated during polishing of a substrate to be polished and of effectively cooling a substrate holding part of the substrate holding mechanism, and also capable of effectively preventing a polishing solution and polishing dust from adhering to an outer peripheral portion of the substrate holding part and drying thereon. The substrate holding mechanism has a mounting flange, a support member 6 and a retainer ring. A substrate to be polished is held on a lower side of the support member surrounded by the retainer ring, and the substrate is pressed against a polishing surface of a polishing table. The mounting flange is provided with a flow passage contiguous with at least the retainer ring. A temperature-controlled gas is supplied through the flow passage to cool the mounting flange, the support member and the retainer ring. The retainer ring is provided with a plurality of through-holes communicating with the flow passage to spray the gas flowing through the flow passage onto the polishing surface of the polishing table.

13 Claims, 12 Drawing Sheets

U.S. PATENT DOCUMENTS

| | | | | |
|---|---|---|---|---|
| 3,611,654 | A | 10/1971 | Weber et al. | |
| 5,506,178 | A | 4/1996 | Suzuki et al. | |
| 5,643,061 | A | 7/1997 | Jackson et al. | |
| 5,645,474 | A | 7/1997 | Kubo et al. | |
| 5,656,516 | A | 8/1997 | Suzuki | |
| 5,679,212 | A | 10/1997 | Kat et al. | |
| 5,762,544 | A | 6/1998 | Zuniga et al. | |
| 5,857,899 | A | 1/1999 | Volodarsky et al. | |
| 6,241,591 | B1 | 6/2001 | Jackson et al. | |
| 6,251,001 | B1 | 6/2001 | Pinson et al. | |
| 6,273,803 | B1 | 8/2001 | Wang et al. | |
| 6,416,384 | B1 * | 7/2002 | Kawamoto et al. | 451/7 |
| 6,468,136 | B1 | 10/2002 | Lum et al. | |
| 6,488,571 | B2 * | 12/2002 | Sharan | 451/53 |
| 6,625,368 | B1 | 9/2003 | Burrows et al. | |
| 6,641,459 | B2 | 11/2003 | Ball | |
| 6,648,734 | B2 | 11/2003 | Chin et al. | |
| 6,682,404 | B2 * | 1/2004 | Brunelli | 451/53 |
| 6,769,961 | B1 | 8/2004 | Kistler et al. | |
| 7,785,175 | B2 * | 8/2010 | Doi et al. | 451/64 |
| 2001/0041500 | A1 | 11/2001 | Ball | |
| 2002/0042246 | A1 * | 4/2002 | Togawa et al. | 451/288 |
| 2002/0081950 | A1 | 6/2002 | Sharan | |
| 2002/0132559 | A1 | 9/2002 | Togawa | |
| 2002/0187728 | A1 | 12/2002 | Hayashi et al. | |
| 2002/0193050 | A1 | 12/2002 | Sharan | |
| 2005/0126708 | A1 | 6/2005 | Chen et al. | |

FOREIGN PATENT DOCUMENTS

| | | | |
|---|---|---|---|
| EP | 0 962 720 | A2 | 12/1999 |
| EP | 0 988 931 | A2 | 3/2000 |
| EP | 1 075 897 | A1 | 2/2001 |
| EP | 1 197 292 | A2 | 4/2002 |
| JP | 7-60621 | | 3/1995 |
| JP | 9-38851 | | 2/1997 |
| JP | 10-277924 | | 10/1998 |
| JP | 10-313032 | | 11/1998 |
| JP | 10-329014 | | 12/1998 |
| JP | 2993497 | | 10/1999 |
| JP | 11-347936 | | 12/1999 |
| JP | 2000-52239 | | 2/2000 |
| JP | 2000-228377 | | 8/2000 |
| JP | 2001-267275 | | 9/2001 |
| JP | 2002-144222 | | 5/2002 |
| JP | 2002-373875 | | 12/2002 |

OTHER PUBLICATIONS

International Search Report issued Aug. 9, 2004 in International Application No. PCT/JP03/17032.

* cited by examiner

SUBSTRATE HOLDING MECHANISM, SUBSTRATE POLISHING APPARATUS AND SUBSTRATE POLISHING METHOD

This application is a divisional of Application No. 12/184,032, filed Jul. 31, 2008, now U.S. Pat No. 7,883,394, which is a divisional of Application No. 10/539,245, which is the National Stage of International Application No. PCT/JP2003/017032, filed Dec. 26, 2003, and now U.S. Pat. No. 7,419,420, issued on Sep. 2, 2008.

TECHNICAL FIELD

The present invention relates to a substrate holding mechanism for use in a polishing apparatus for polishing a surface of a substrate, e.g. a semiconductor wafer, to make this substrate surface flat. The present invention also relates to a substrate polishing apparatus and a substrate polishing method that use the substrate holding mechanism.

BACKGROUND ART

With progress of technology of fabricating high-integration semiconductor devices in recent years, circuit wiring patterns or interconnections have been becoming increasingly small and fine, and spacings between wiring patterns have also been decreasing. As these wiring spacing decreases, a depth of focus becomes shallower in circuit pattern formation by performing photolithography or the like. In a case of photolithography for less than 0.5-μm designs in particular, surfaces of semiconductor wafers on which circuit pattern images are to be formed by a photolithographic apparatus require a higher degree of surface flatness because of a photolithography depth of focus. To realize a required degree of surface flatness, polishing using a polishing apparatus is widely adopted.

A polishing apparatus of this type has a turntable with a polishing cloth bonded to a top thereof to form a polishing surface. The polishing apparatus further has a top ring as a substrate holding mechanism. The turntable and the top ring rotate independently of each other at respective numbers of revolutions. A substrate to be polished that is held by the top ring is pressed against a polishing surface of the turntable while a polishing solution is being supplied onto the polishing surface, thereby polishing a surface of the substrate to a flat and specular surface. After completion of polishing, the substrate is released from the top ring body and transferred to a subsequent process, e.g. a cleaning process.

In the above-described polishing apparatus, a substrate holding part of the top ring, which holds the substrate to be polished, may be deformed by frictional heat generated during polishing of the substrate. Further, a polishing capability may vary owing to a temperature distribution on the polishing surface. Such deformation of the substrate holding part of the top ring and variations of the polishing capability cause a substrate polishing function to be degraded. Further, this type of polishing apparatus polishes the substrate while supplying a polishing solution, e.g. a slurry, onto the polishing surface of the polishing table, as stated above. The polishing solution is likely to adhere to an outer surface of the top ring, particularly an outer peripheral surface thereof, and to dry thereon. If dried solid matter drops onto the polishing surface, an adverse influence is exerted on a polishing process.

To prevent deformation of the substrate holding part of the top ring due to frictional heat generated during polishing of the substrate, JP-A-11-347936 (Japanese Patent Application Unexamined Publication) discloses that a material of good thermal conductivity is attached to a substrate holding part (wafer holder) to make a temperature distribution uniform, and a refrigerant flow passage is provided in the substrate holding part to supply a refrigerant through the refrigerant flow passage to cool the substrate holding part, and further, fins are provided on the substrate holding part to promote heat dissipation. However, the method disclosed in JP-A-11-347936 is still insufficient to effectively cool an outer peripheral portion (particularly a guide ring) of the substrate holding part of the top ring, and hence suffers from a problem in that a polishing solution, e.g. a slurry, may adhere to the outer peripheral portion of the substrate holding part and dry to stick fast thereto, together with polishing dust generated from the substrate by polishing.

With an increase in diameter of semiconductor substrates, an area of contact between a polishing pad on the polishing table and the substrate to be polished has increased. Consequently, a temperature tends to rise during polishing the substrate. Meanwhile, it has become common practice to use substrate polishing apparatus having a complicated mechanism for a purpose of controlling a polishing profile. Many of the polishing apparatus employ a method whereby a component part having a high coefficient of friction is pressed into contact with a polishing pad in the complicated mechanism. This may also cause a rise in temperature during polishing.

The rise in temperature during polishing of the substrate exerts an influence on a surface of the polishing pad and slurry components, and causes degradation of flatness of a polished surface of the substrate obtained with the polishing apparatus and a polishing rate, and also makes it impossible to maintain a desired flatness and polishing rate stably.

SUMMARY OF THE INVENTION

The present invention was made in view of the above-described circumstances. An object of the present invention is to provide a substrate holding mechanism, a substrate polishing apparatus and a substrate polishing method that have functions capable of minimizing an amount of heat generated during polishing of a substrate to be polished, and/or of effectively cooling a substrate holding part of the substrate holding mechanism and a polishing surface of a polishing table, and/or also capable of maintaining the temperature of the polishing surface of the polishing table and a substrate within a predetermined temperature range during polishing of the substrate, and/or hence stably maintaining flatness of a polished surface of the substrate and a polishing rate, and/or further capable of effectively preventing the polishing solution and polishing dust from adhering to an outer peripheral portion of the substrate holding part and drying thereon.

The present invention provides a substrate holding mechanism having a mounting flange, a support member secured to the mounting flange, and a retainer ring secured to the mounting flange and surrounding an outer periphery of the support member. A substrate to be polished is held on a lower side of the support member surrounded by the retainer ring, and the substrate is pressed against a polishing surface. In the substrate holding mechanism, the retainer ring is made of a polyimide compound.

The following are advantages in use of a retainer ring made of a polyimide compound as stated above. Polyimide compounds exhibit a minimal wear rate with respect to a polishing pad forming a polishing surface and generate a minimal amount of heat by friction, as will be detailed later. Therefore, the retainer ring has an increased lifetime, and it is possible to maintain high polishing performance over a long period of time and to minimize a rise in temperature of the polishing surface.

The present invention provides a substrate holding mechanism having a mounting flange, a support member secured to the mounting flange, and a retainer ring secured to the mounting flange and surrounding an outer periphery of the support member. A substrate to be polished is held on a lower side of the support member surrounded by the retainer ring, and the substrate is pressed against a polishing surface of a polishing table. The mounting flange is provided with a flow passage contiguous with at least the retainer ring, and a temperature-controlled gas is supplied through the flow passage to cool the mounting flange, the support member and the retainer ring.

As stated above, the mounting flange is provided with a flow passage contiguous with at least the retainer ring, and a temperature-controlled gas is supplied through the flow passage. Consequently, if the retainer ring generates heat by friction during polishing of the substrate, the heat can be effectively removed. Therefore, high polishing performance can be maintained.

According to the present invention, the retainer ring in the substrate holding mechanism is provided with a plurality of through-holes communicating with the flow passage to spray gas flowing through the flow passage onto the polishing surface of the polishing table.

As stated above, the retainer ring is provided with a plurality of through-holes, and a temperature-controlled gas is supplied through the flow passage. Thus, the temperature-controlled gas is sprayed onto the polishing surface through the through-holes. Consequently, the polishing surface can be effectively cooled, and a rise in temperature of the polishing surface can be minimized.

According to the present invention, the substrate holding mechanism is provided with switching structure for selectively supplying a cooling gas and a retainer ring cleaning liquid to the flow passage.

Provision of the switching structure for selectively supplying a cooling gas and a retainer ring cleaning liquid to the flow passage as stated above enables cooling of the retainer ring and the polishing surface, and cleaning of the retainer ring, to be selectively performed.

According to the present invention, the temperature-controlled gas supplied through the flow passage in the substrate holding mechanism is a moist gas.

By using a moist and temperature-controlled gas supplied through the flow passage as stated above, it is possible to cool the retainer ring and to prevent polishing solution and polishing dust adhering to the retainer ring from drying.

According to the present invention, the substrate holding mechanism has a pressurizing chamber provided between the mounting flange and the support member, and a pressure fluid is supplied to the pressurizing chamber to press the support member. Pressure of the gas supplied through the flow passage is lower than pressure of the fluid supplied to the pressurizing chamber.

By setting the pressure of the gas supplied through the flow passage lower than the pressure of the fluid supplied to the pressurizing chamber as stated above, the retainer ring can be cooled without an influence of pressure of the gas supplied through the flow passage, that is, a flow passage pressure, on the pressure in the pressurizing chamber for pressing the support member.

The present invention provides a substrate polishing apparatus having a substrate holding mechanism and a polishing table with a polishing surface. A substrate to be polished that is held by the substrate holding mechanism is pressed against the polishing surface of the polishing table, and the substrate is polished by relative movement between the substrate held by the substrate holding mechanism and the polishing surface of the polishing table. The substrate holding mechanism is any one of those described above.

Use of the above-described substrate holding mechanism in the substrate polishing apparatus enables realization of a substrate polishing apparatus exhibiting the above-described characteristics of the substrate holding mechanism, and hence capable of excellent polishing of a substrate.

The present invention provides a substrate polishing apparatus having a substrate holding mechanism and a polishing table with a polishing surface. A substrate to be polished that is held by the substrate holding mechanism is pressed against the polishing surface of the polishing table, and the substrate is polished by relative movement between the substrate held by the substrate holding mechanism and the polishing surface of the polishing table. The substrate polishing apparatus is provided with cooling structure for cooling the polishing surface of the polishing table and a substrate holding part of the substrate holding mechanism.

Provision of the cooling structure for cooling the polishing surface of the polishing table and the substrate holding part of the substrate holding mechanism as stated above enables the polishing surface of the polishing table and the substrate holding part of the substrate holding mechanism to be maintained within a predetermined temperature range during polishing of the substrate and hence allows the substrate to be stably polished with desired flatness and at a predetermined polishing rate.

According to the present invention, the cooling structure in the substrate polishing apparatus is arranged as follows. The polishing surface of the polishing table and the substrate holding part of the substrate holding mechanism are covered with a dome having an inlet port and an outlet port, and the polishing surface of the polishing table and the substrate holding part of the substrate holding mechanism are cooled with a gas stream induced by locally evacuating an interior of the dome.

As stated above, the polishing surface of the polishing table and the substrate holding part of the substrate holding mechanism are covered with a dome having an inlet port and an outlet port, and the polishing surface of the polishing table and the substrate holding part of the substrate holding mechanism are cooled with a gas stream induced by locally evacuating the interior of the dome. Therefore, the polishing surface of the polishing table and the substrate holding part of the substrate holding mechanism can be maintained within a predetermined temperature range during polishing of a substrate with a simple arrangement without changing a basic structure of existing substrate polishing apparatus.

According to the present invention, the cooling structure in the substrate polishing apparatus includes low-temperature gas supply structure arranged so that a low-temperature gas can be supplied into the dome from the low-temperature gas supply structure through the inlet port.

Provision of the above-described low-temperature gas supply structure offers the following advantage. In a case where the polishing surface of the polishing table and the substrate holding part of the substrate holding mechanism cannot be maintained within a predetermined temperature range during polishing of the substrate simply by using a gas stream induced by locally evacuating the interior of the dome, a low-temperature gas is supplied into the dome from the low-temperature gas supply structure through the inlet port, whereby the polishing surface of the polishing table and the substrate holding part of the substrate holding mechanism can be readily maintained within a predetermined temperature range during polishing of the substrate.

According to the present invention, the cooling structure in the substrate polishing apparatus is arranged at the portion of the polishing surface which is neighboring the substrate holding mechanism and a side where the polishing table moves relative to the substrate, and the cooling structure is also arranged so that the substrate holding part of the substrate holding mechanism is placed within a flow path of a gas stream induced by local evacuation.

As stated above, the neighborhood of a portion of the polishing surface of the polishing table at a side thereof where the polishing table moves relative to the substrate, that is, the neighborhood of a portion of the polishing surface of the polishing table at a side thereof where a large amount of frictional heat is generated because of a large amount of relative movement between the polishing surface and the substrate, and the substrate holding part of the substrate holding mechanism are placed within the flow path of a gas stream induced by local evacuation. Consequently, a portion of the polishing surface that generates a large amount of frictional heat can be effectively cooled, and thus the polishing surface of the polishing table and the substrate holding part of the substrate holding mechanism can be maintained within a predetermined temperature range.

According to the present invention, the cooling structure in the substrate polishing apparatus includes a partition plate provided in the dome to control a gas stream induced by local evacuation so that the neighborhood of a portion of the polishing surface of the polishing table at a side thereof where the polishing table moves relative to the substrate, and the substrate holding part of the substrate holding mechanism, are placed within the flow path of the gas stream induced by local evacuation.

As stated above, the polishing surface of the polishing table and the substrate holding part of the substrate holding mechanism are covered with a dome having an inlet port and an outlet port, and a partition plate for controlling a gas stream induced by local evacuation is provided. Consequently, the neighborhood of a portion of the polishing surface of the polishing table at a side thereof where the polishing table moves relative to the substrate, and the substrate holding part of the substrate holding mechanism, can be placed within the flow path of the gas stream induced in the dome. Therefore, the polishing surface of the polishing table and the substrate holding part of the substrate holding mechanism can be maintained within a predetermined temperature range during polishing of the substrate with a simple arrangement without changing a basic structure of existing substrate polishing apparatus.

According to the present invention, the cooling structure in the substrate polishing apparatus includes room-temperature gas supply structure or low-temperature gas supply structure to cool the polishing surface of the polishing table and the substrate holding part of the substrate holding mechanism with a room-temperature gas from the room-temperature gas supply structure or a low-temperature gas from the low-temperature gas supply structure.

As stated above, the polishing surface of the polishing table and the substrate holding part of the substrate holding mechanism are cooled with a room-temperature gas from the room-temperature gas supply structure or a low-temperature gas from the low-temperature gas supply structure. Therefore, the polishing surface of the polishing table and the substrate holding part of the substrate holding mechanism can be maintained within a predetermined temperature range during polishing of the substrate with a simple arrangement without changing a basic structure of existing substrate polishing apparatus.

According to the present invention, the room-temperature gas supply structure or the low-temperature gas supply structure in the substrate polishing apparatus is installed so as to cool the neighborhood of a portion of the polishing surface of the polishing table at a side thereof where the polishing table moves relative to the substrate.

As stated above, the room-temperature gas supply structure or the low-temperature gas supply structure cools the neighborhood of a portion of the polishing surface of the polishing table at a side thereof where the polishing table moves relative to the substrate, that is, the neighborhood of a portion of the polishing surface of the polishing table at a side thereof where a large amount of frictional heat is generated because of a large amount of relative movement between the polishing surface and the substrate. Therefore, the polishing surface of the polishing table and the substrate holding part of the substrate holding mechanism can be effectively maintained within a predetermined temperature range.

According to the present invention, the cooling structure in the substrate polishing apparatus includes low-temperature gas supply structure to cool the substrate being polished by supplying a low-temperature gas from the low-temperature gas supply structure to a reverse side of the substrate.

As stated above, a low-temperature gas is supplied from the low-temperature gas supply structure to the reverse side of the substrate being polished to cool the substrate. Consequently, the substrate can be cooled efficiently. Accordingly, it is possible to maintain the substrate at a predetermined temperature and hence possible to polish the substrate stably with desired flatness and at a predetermined polishing rate.

According to the present invention, the cooling structure in the substrate polishing apparatus includes a fixed flow control valve for ensuring a predetermined flow velocity for the low-temperature gas supplied from the low-temperature gas supply structure.

Provision of the fixed flow control valve as stated above allows the low-temperature gas supplied to the reverse side of the substrate to flow at a predetermined flow velocity without stagnating. Therefore, a temperature of the substrate being polished can be maintained within a predetermined temperature range.

According to the present invention, the fixed flow control valve in the substrate polishing apparatus is an opening-adjustable fixed flow control valve whose valve opening is adjustable.

Use of an opening-adjustable fixed flow control valve as the fixed flow control valve as stated above enables control of flow velocity of the low-temperature gas supplied to the reverse side of the substrate being polished. Therefore, a temperature of the substrate being polished can be controlled within a predetermined temperature range.

According to the present invention, the substrate polishing apparatus includes, as structure for transferring the substrate after polishing, a vacuum holding mechanism having evacuating structure for evacuating the low-temperature gas from a flow passage supplying the low-temperature gas to hold the substrate by sucking the low-temperature gas from the flow passage.

Provision of the vacuum holding mechanism as stated above makes it possible to transfer the substrate by vacuum-holding it by making use of the low-temperature gas flow passage for cooling the substrate, i.e. by evacuating the low-temperature gas supply passage through the evacuating structure.

According to the present invention, the substrate polishing apparatus has a check valve provided in piping where the fixed flow control valve is installed.

As stated above, a check valve is provided in piping where the fixed flow control valve is installed. Consequently, when the flow passage is evacuated by the evacuating structure, no gas will flow backward into the flow passage. Therefore, it is possible to hold the substrate by vacuum.

The present invention provides a substrate polishing method wherein a substrate to be polished, that is held by a substrate holding mechanism, is pressed against a polishing surface of a polishing table, and while a polishing solution is being supplied onto the polishing surface, the substrate is polished by relative movement between the substrate and the polishing surface. During polishing of the substrate, a temperature of the substrate is maintained in a range of from 40° C. to 65° C.

As stated above, the temperature of the substrate is maintained in the range of from 40° C. to 65° C. during polishing of the substrate, whereby the substrate can be polished stably with desired flatness and at a predetermined polishing rate.

The present invention provides a substrate polishing method wherein a substrate to be polished, that is held by a substrate holding mechanism, is pressed against a polishing surface of a polishing table, and while a polishing solution is being supplied onto the polishing surface, the substrate is polished by relative movement between the substrate and the polishing surface. During polishing of the substrate, a temperature of the polishing surface of the polishing table and the substrate temperature are maintained in a range of from 40° C. to 65° C.

As stated above, the temperature of the polishing surface of the polishing table and a substrate temperature are maintained in the range of from 40° C. to 65° C. during polishing of the substrate, whereby the flatness of a polished surface of the substrate and a polishing rate can be stabilized.

In the substrate polishing method according to the present invention, the polishing surface of the polishing table and the substrate holding part of the substrate holding mechanism are covered with a dome having an inlet port and an outlet port, and the polishing surface of the polishing table and the substrate holding part of the substrate holding mechanism are cooled with a gas stream induced by locally evacuating the interior of the dome and with a low-temperature gas supplied from low-temperature gas supply structure.

As stated above, the polishing surface of the polishing table and the substrate holding part of the substrate holding mechanism are covered with a dome having an inlet port and an outlet port, and the polishing surface of the polishing table and the substrate holding part of the substrate holding mechanism are cooled with a gas stream induced by locally evacuating the interior of the dome and with a low-temperature gas supplied from low-temperature gas supply structure. Therefore, it is possible to perform polishing while maintaining the polishing surface of the polishing table and the substrate holding part of the substrate holding mechanism within a predetermined temperature range easily without changing a basic structure of existing substrate polishing apparatus.

In the substrate polishing method according to the present invention, the neighborhood of a portion of the polishing surface of the polishing table at a side thereof where the polishing table moves relative to the substrate is placed within the flow path of a gas stream induced by local evacuation to cool the polishing surface and the substrate holding part of the substrate holding mechanism.

As stated above, the neighborhood of a portion of the polishing surface of the polishing table at a side thereof where the polishing table moves relative to the substrate is placed within the flow path of a gas stream induced by local evacuation. Consequently, a portion of the polishing surface that generates a large amount of frictional heat can be effectively cooled, and it becomes easy to maintain a temperature of the polishing surface of the polishing table and the substrate holding part of the substrate holding mechanism within a predetermined temperature range.

In the substrate polishing method according to the present invention, the polishing surface of the polishing table and the substrate holding part of the substrate holding mechanism are cooled with a room-temperature gas from room-temperature gas supply structure or a low-temperature gas from low-temperature gas supply structure.

As stated above, the polishing surface of the polishing table and the substrate holding part of the substrate holding mechanism are cooled with a room-temperature gas from room-temperature gas supply structure or a low-temperature gas from low-temperature gas supply structure. Consequently, a temperature of the polishing surface of the polishing table and the substrate holding part of the substrate holding mechanism can be maintained in the range of from 40° C. to 65° C. during polishing of the substrate without changing a structure of existing substrate polishing apparatus.

In the substrate polishing method according to the present invention, cooling of the polishing surface of the polishing table is effected by cooling the neighborhood of a portion of the polishing surface of the polishing table at a side thereof where the polishing table moves relative to the substrate.

As stated above, cooling of the polishing surface of the polishing table is effected by cooling the neighborhood of a portion of the polishing surface of the polishing table at a side thereof where the polishing table moves relative to the substrate, that is, the neighborhood of a portion of the polishing surface of the polishing table at a side thereof where a large amount of frictional heat is generated. Consequently, a temperature of the polishing surface of the polishing table can be maintained within the above-described temperature range.

In the substrate polishing method according to the present invention, a low-temperature gas is supplied to the reverse side of the substrate being polished from low-temperature gas supply structure to cool the substrate.

As stated above, a low-temperature gas is supplied to the reverse side of the substrate being polished from low-temperature gas supply structure to cool the substrate. Consequently, it becomes easy to maintain the substrate at a predetermined temperature. Accordingly, the substrate can be polished stably with desired flatness and at a predetermined polishing rate.

In the substrate polishing method according to the present invention, the substrate to be polished is a substrate having a thin film of wiring material formed over a primary layer, including recesses formed therein. The substrate is polished to remove the wiring material, exclusive of the wiring material in the recesses.

As stated above, a substrate having a thin film of wiring material formed over a primary layer, including recesses formed therein, is polished with the substrate temperature maintained in a range of from 40° C. to 65° C. Therefore, it is possible to perform polishing whereby the wiring material is removed from the substrate, exclusive of the wiring material in the recesses, stably with desired flatness and at a predetermined polishing rate.

EXPLANATION OF REFERENCE SIGNS

Figure 1:
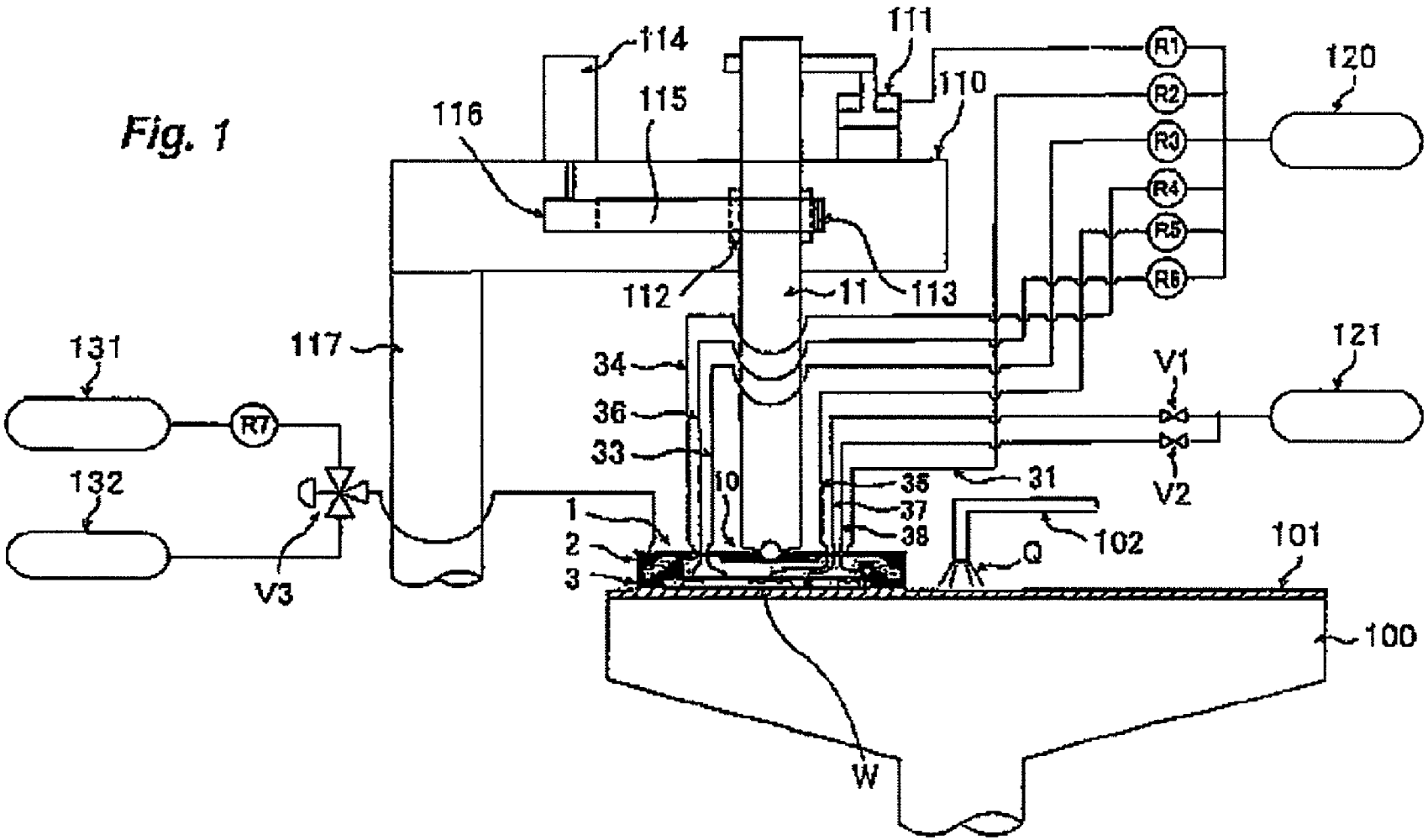
FIG. 1 is a diagram showing an arrangement of a substrate polishing apparatus according to the present invention.

1 top ring
2 mounting flange
3 retainer ring
4 elastic pad
5 holder ring
6 support member
7 pressurizing sheet
8 center abutting member
9 outside abutting member
10 universal joint
11 top ring driving shaft
12 bearing ball
31 to 38 fluid passage
100 polishing table
101 polishing pad
102 polishing solution supply nozzle
110 top ring head
111 top ring air cylinder
112 rotary cylinder
113 timing pulley
114 top ring driving motor
115 timing belt
116 timing pulley
117 top ring head shaft
120 compressed air source
121 vacuum source
131 air supply source
132 cleaning liquid supply source
200 polishing table
201 polishing pad
202 polishing solution supply nozzle
221 top ring
222 top ring driving shaft
230 top ring body
231 substrate guide
232 low-temperature gas flow passage
234 low-temperature gas discharge passage
235 opening-adjustable fixed flow control valve
236 check valve
240 dome
241 inlet port
242 outlet port
243 outlet duct
244 low-temperature gas supply device
245 partition plate
246 pad surface cooling device

DETAILED DESCRIPTION OF THE PREFERRED EMBODIMENTS

Embodiments of the present invention will be described below with reference to the accompanying drawings. FIG. 1 is a diagram showing a general structure of a substrate polishing apparatus according to the present invention. As illustrated in this figure, the substrate polishing apparatus has a top ring 1 as a substrate holding mechanism and a polishing table 100 with a polishing pad 101 bonded thereto. The polishing pad 101 has a polishing surface. A substrate W to be polished, e.g. a substrate wafer, which is held by the top ring 1, is pressed against the polishing surface of the polishing pad 101 on the polishing table 100. The substrate W is polished by rotational motion of the substrate W held by the top ring 1 and rotational motion of the polishing surface of the polishing pad 101. In addition, an abrasive liquid Q is supplied onto the polishing pad 101 on the polishing table 100 from a polishing solution supply nozzle 102 provided above the polishing table 100.

It should be noted that there are various polishing pads usable as the polishing pad 101, for example, SUBA800, IC-1000 and IC-1000/SUBA400 (double-layer cloth), which are available from Rodel, Inc., and Surf in xxx-5 and Surf in 000, which are available from Fujimi Incorporated. SUBA800, Surf in xxx-5 and Surf in 000 are nonwoven fabrics formed by binding fibers with a urethane resin. IC-1000 is made of a rigid urethane foam (single layer). The urethane foam is porous and has a large number of small recesses or pores in a surface thereof.

The top ring 1 is connected to a top ring driving shaft 11 through a universal joint 10. The top ring driving shaft 11 is coupled to a top ring air cylinder 111 secured to a top ring head 110. The top ring driving shaft 11 is driven to move vertically by the top ring air cylinder 111, thereby causing the top ring 1 in its entirety to move vertically and further causing a retainer ring 3 secured to a lower end of a mounting flange 2 to be pressed against the polishing pad 101. The top ring air cylinder 111 is connected to a compressed air source 120 through a regulator R1. The regulator R1 allows adjustment of pneumatic pressure of pressurized air supplied to the top ring air cylinder 111. Consequently, it is possible to adjust a pressing force with which the retainer ring 3 presses the polishing pad 101.

Further, the top ring driving shaft 11 is connected to a rotary cylinder 112 through a key (not shown). The rotary cylinder 112 has a timing pulley 113 on an outer peripheral portion thereof. A top ring driving motor 114 is secured to the top ring head 110. The timing pulley 113 is connected to a timing pulley 116 provided on the top ring driving motor 114 through a timing belt 115. Accordingly, when the top ring driving motor 114 is activated, the rotary cylinder 112 and the top ring driving shaft 11 rotate together as one unit through the timing pulley 116, the timing belt 115 and the timing pulley 113, thereby causing the top ring 1 to rotate. It should be noted that the top ring head 110 is supported by a top ring head shaft 117 fixedly supported on a frame (not shown).

Figure 2:
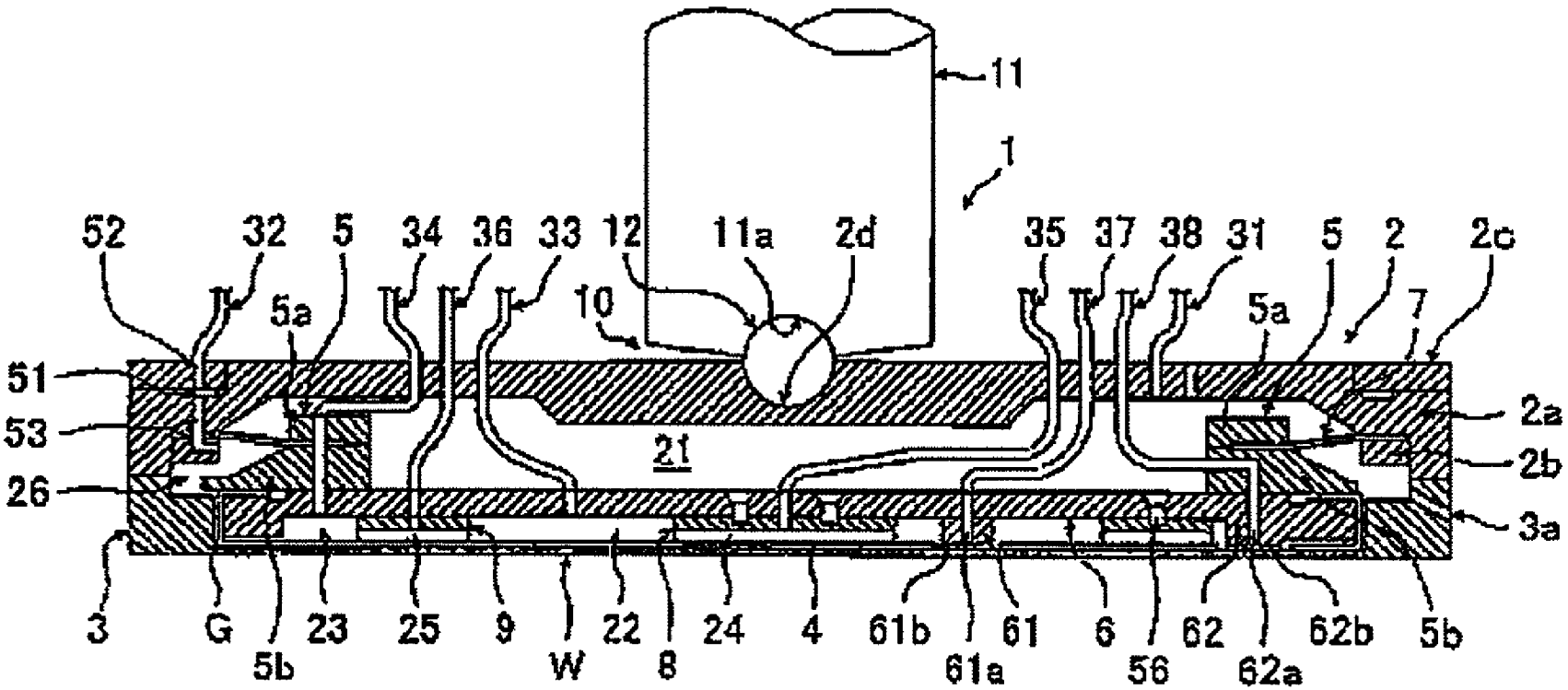
FIG. 2 is a sectional side view showing an arrangement of a substrate holding mechanism according to the present invention.

FIG. 2 is a vertical sectional view showing a structural example of a top ring, which is a substrate holding mechanism according to the present invention. As illustrated in this figure, the top ring 1 has mounting flange 2 and retainer ring 3 secured to a lower end of an outer peripheral edge of the mounting flange 2. The mounting flange 2 is formed of a metallic or ceramic material exhibiting high strength and rigidity. The retainer ring 3 is formed of a resin or ceramic material having high rigidity. In this embodiment, a retainer ring 3 formed of a polyimide compound is used as will be detailed later.

The mounting flange 2 has a cylindrical container-shaped housing part 2*a*, an annular pressurizing sheet support part 2*b* fitted to an inner side of a cylindrical portion of the housing part 2*a*, and an annular seal part 2*c* fitted to a top of an upper outer peripheral edge of the housing part 2*a*. The retainer ring 3 is secured to a lower end of the housing part 2*a* of the mounting flange 2. A lower portion of the retainer ring 3 projects inward. It should be noted that the retainer ring 3 and the mounting flange 2 may be formed as one integral structure.

The top ring driving shaft 11 is disposed above a center of the housing part 2*a* of the mounting flange 2. The mounting flange 2 and the top ring driving shaft 11 are coupled to each other through the universal joint 10. The universal joint 10 has a spherical bearing mechanism that allows the mounting flange 2 and the top ring driving shaft 11 to tilt relative to each other, and a rotation transmitting mechanism for transmitting rotation of the top ring driving shaft 11 to the top ring body. Thus, the universal joint 10 enables pressing force and rotational force to be transmitted from the top ring driving shaft 11 to the mounting flange 2 while allowing these members to tilt relative to each other.

The spherical bearing mechanism comprises a spherical recess 11*a* formed in a center of a lower surface of the top ring driving shaft 11, a spherical recess 2*d* formed in a center of an upper surface of the housing part 2*a*, and a bearing ball 12 interposed between the recesses 11*a* and 2*d*. The bearing ball 12 is made of a high-rigidity material such as a ceramic material. The rotational transmitting mechanism comprises a driving pin (not shown) secured to the top ring driving shaft 11 and a driven pin (not shown) secured to the housing part 2*a*. Even if the mounting flange 2 tilts, the driven pin and the driving pin are vertically movable relative to each other while shifting a point of contact therebetween. That is, the driving pin and the driven pin are kept in engagement with each other. Thus, the rotation transmitting mechanism surely transmits rotational torque from the top ring driving shaft 11 to the mounting flange 2.

A space is defined inside the mounting flange 2 and the retainer ring 3 integrally secured to the mounting flange 2. The space contains an elastic pad 4 abutting substrate W to be polished, e.g. a semiconductor wafer, which is held by the top ring 1, and an annular holder ring 5, together with an approximately disk-shaped support member 6 for supporting the elastic pad 4. The elastic pad 4 has its outer peripheral portion held between the holder ring 5 and the support member 6 secured to a lower end of the holder ring 5. The elastic pad 4 covers a lower side of the support member 6. Thus, a space is formed between the elastic pad 4 and the support member 6.

A pressurizing sheet 7 made from an elastic membrane is stretched between the holder ring 5 and the mounting flange 2. One end of the pressurizing sheet 7 is held between the housing part 2*a* and the pressurizing sheet support part 2*b* of the mounting flange 2. Another end of the pressurizing sheet 7 is held between an upper end portion 5*a* of the holder ring 5 and a stopper portion 5*b* thereof. In this way, the pressurizing sheet 7 is secured. A pressure chamber 21 is formed inside the mounting flange 2 by the mounting flange 2, the support member 6, the holder ring 5 and the pressurizing sheet 7.

A fluid passage 31 communicates with the pressure chamber 21. The fluid passage 31 comprises a tube, a connector, and the like. The pressure chamber 21 is connected to a compressed air source 120 through a regulator R2 disposed in the fluid passage 31. It should be noted that the pressurizing sheet 7 is formed of a rubber material excellent in terms of strength and durability, e.g. ethylene propylene rubber (EPDM), polyurethane rubber, or silicone rubber.

In a case where the pressurizing sheet 7 is an elastic member, e.g. rubber, if it is secured by being held between the retainer ring 3 and the mounting flange 2, it becomes impossible to obtain a preferable plane at a lower side of the retainer ring 3 because of elastic deformation of the pressurizing sheet 7 as an elastic member. To prevent this problem, in this embodiment, the pressurizing sheet support part 2*b* is provided as an extra member to secure the pressurizing sheet 7 by holding it between the housing part 2*a* and the pressurizing sheet support part 2*b*.

A flow passage 51 comprising an annular groove is formed near an upper outer peripheral edge of the housing part 2*a* to which a seal part 2*c* of the mounting flange 2 is fitted. The flow passage 51 communicates with a fluid passage 32 through a through-hole 52 in the seal part 2*c*. The fluid passage 32 is connected to an air supply source 131 through a three-way switching valve V3 and a regulator R7, and to a cleaning liquid supply source 132 through the switching valve V3. Thus, the fluid passage 32 can be selectively supplied with temperature-controlled air or temperature-controlled moist air from the air supply source 131 or a cleaning liquid (pure water) from the cleaning liquid supply source 132 by switching the three-way switching valve V3. A plurality of communicating holes 53 are provided to extend from the flow passage 51 through the housing part 2*a* and the pressurizing sheet support part 2*b*. The communicating holes 53 communicate with a slight gap G between an outer peripheral surface of the elastic pad 4 and the retainer ring 3, and also communicate with a plurality of through-holes 3*a* provided in the retainer ring 3.

Figure 3:
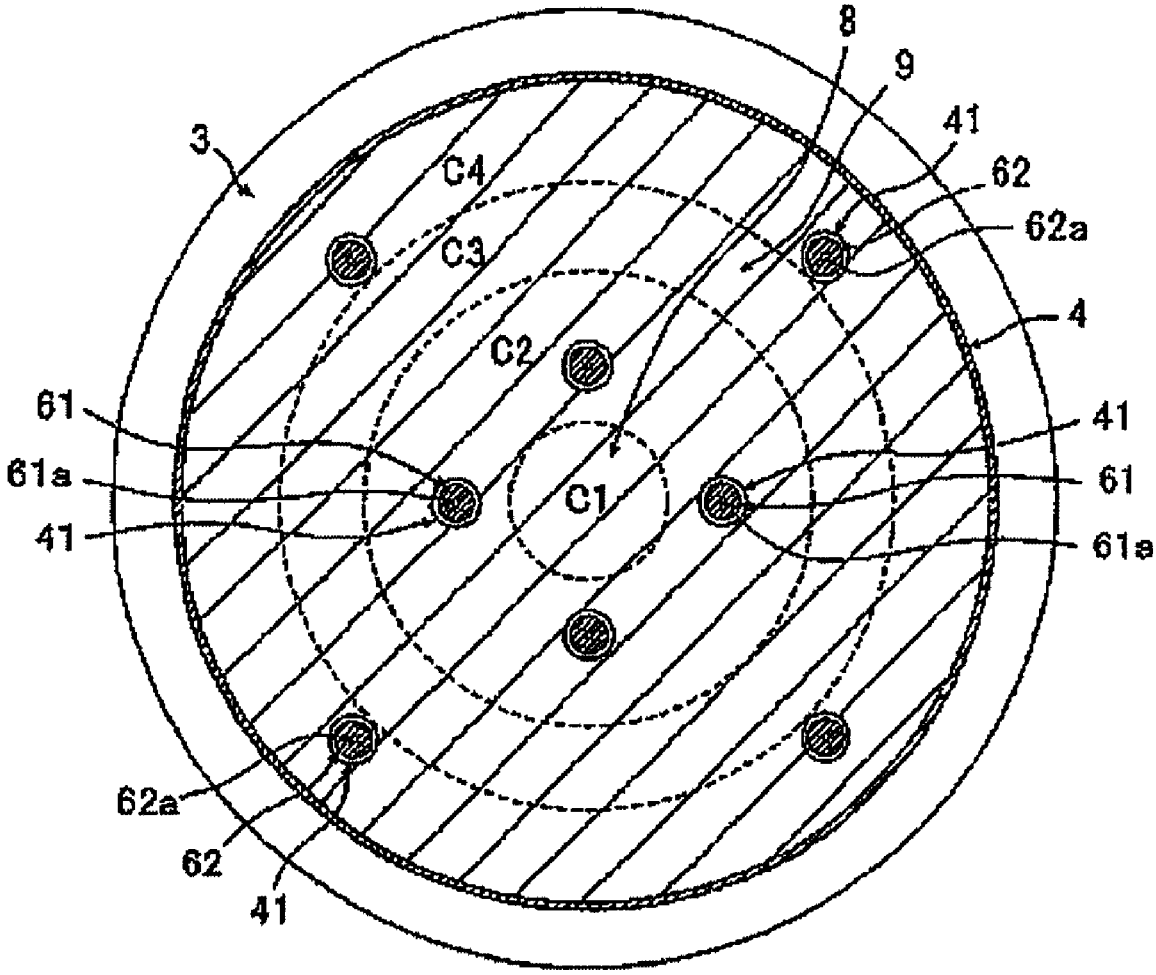
FIG. 3 is a plan view showing a substrate holding part of the substrate holding mechanism according to the present invention.

A space formed between the elastic pad 4 and the support member 6 is provided therein with a central abutting member 8, which is an abutting member that abuts the elastic pad 4, and a ring-shaped outside abutting member 9. In this embodiment, as shown in FIGS. 2 and 3, the central abutting member 8 is disposed on a center of a lower surface of the support member 6, and the outside abutting member 9 is disposed outside the central abutting member 8. It should be noted that the elastic pad 4, the central abutting member 8 and the outside abutting member 9 are formed of a rubber material excellent in terms of strength and durability, e.g. ethylene propylene rubber (EPDM), polyurethane rubber, or silicone rubber as in the case of the pressurizing sheet 7.

The space formed between the support member 6 and the elastic pad 4 is divided into a plurality of space sections (second pressure chamber) by the central abutting member 8 and the outside abutting member 9. Thus, a pressure chamber 22 is formed between the central abutting member 8 and the outside abutting member 9, and a pressure chamber 23 is formed outside the outside abutting member 9.

Figure 4A:
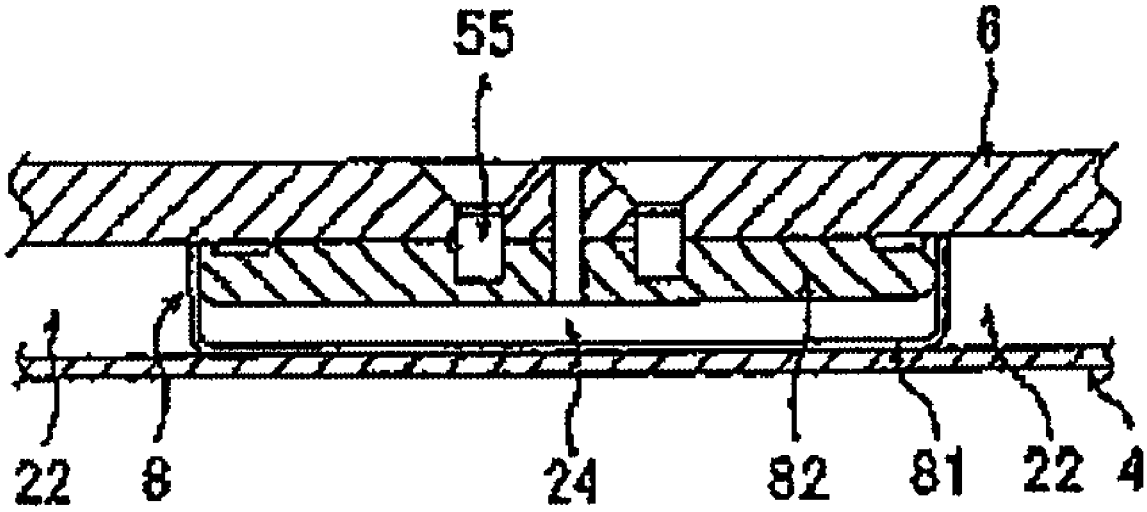
FIGS. 4*a* and 4*b* are fragmentary sectional side views of the substrate holding mechanism according to the present invention.
Figure 4B:
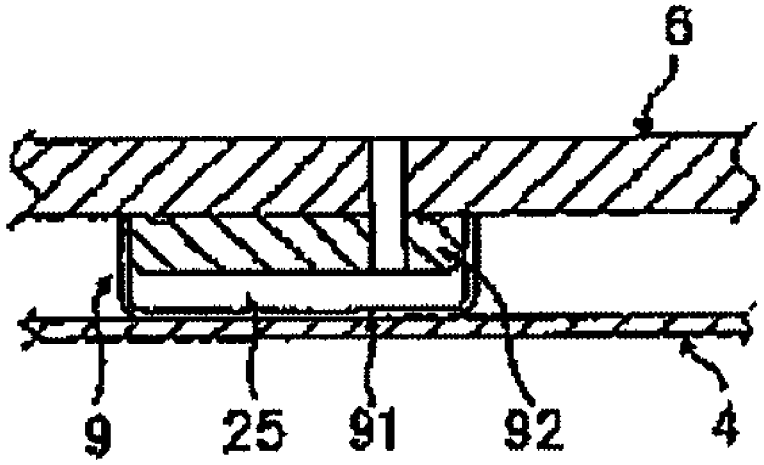

As shown in FIG. 4(*a*), the central abutting member 8 comprises an elastic membrane 81 abutting the upper surface of the elastic pad 4, and a central abutting member holding part 82 that detachably holds the elastic membrane 81. The central abutting member holding part 82 is detachably secured to the center of the lower surface of the support member 6 with screws 55. A central pressure chamber 24 (first pressure chamber) is formed in the central abutting member 8 by the elastic membrane 81 and the central abutting member holding part 82.

Similarly, the outside abutting member 9 comprises, as shown in FIG. 4(*b*), an elastic membrane 91 abutting the upper surface of the elastic pad 4, and a outside abutting member holding part 92 that detachably holds the elastic membrane 91. The outside abutting member holding part 92 is detachably secured to the lower surface of the support member 6 with screws 56 (see FIG. 2). An intermediate pressure chamber 25 (second pressure chamber) is formed in the outside abutting member 9 by the elastic membrane 91 and the outside abutting member holding part 92.

Fluid passages 33, 34, 35 and 36 communicate with the pressure chamber 22, the pressure chamber 23, the central pressure chamber 24 and the intermediate pressure chamber 25, respectively. The fluid passages 33, 34, 35 and 36 each comprise a tube, a connector, and the like. The pressure chambers 22 to 25 are connected to the compressed air source 120, which serves as a supply source, through regulators R3, R4, R5 and R6 disposed in the fluid passages 33 to 36, respectively. It should be noted that the fluid passages 31 to 36 are connected to respective regulators R1 to R6 through a rotary joint (not shown) provided at an upper end of the top ring head 110.

The pressure chamber 21 above the support member 6 and the pressure chambers 22 to 25 are supplied with a pressurized fluid, e.g. pressurized air, or an atmospheric pressure or a vacuum, through the fluid passages 31, 33, 34, and 36 communicating with respective pressure chambers 21 to 25. As shown in FIG. 1, pressure of a pressurized fluid supplied to each of the pressure chambers 21 to 25 can be adjusted with the regulators R2 to R6 disposed in the fluid passages 31, 33, 34, 35 and 36 of the pressure chambers 21 to 25. Thus, the pressure in each of the pressure chambers 21 to 25 can be controlled or changed to an atmospheric pressure or a vacuum independently of each other. With this arrangement whereby the pressure in each of the pressure chambers 21 to 25 can be varied independently with the regulators R2 to R6, a pressing force with which the substrate W to be polished is pressed against the polishing pad 101 through the elastic pad 4 can be adjusted for each portion of the substrate W.

As shown in FIG. 3, the elastic pad 4 is provided with a plurality of openings 41. The support member 6 is provided with inner peripheral suction-holding portions 61 projecting therefrom downward so as to expose themselves from respective openings 41 between the central abutting member 8 and the outside abutting member 9. Further, the support member 6 is provided with outer peripheral suction-holding portions 62 projecting downward so as to expose themselves from the respective openings 41 outside the outside abutting member 9. In this embodiment, the elastic pad 4 is provided with eight openings 41, and the suction-holding portions 61 and 62 are provided so as to expose themselves from the respective openings 41.

Each inner peripheral suction-holding portion 61 is formed with a communicating hole 61*a* communicating with a fluid passage 37. Each outer peripheral suction-holding portion 62 is formed with a communicating hole 62*a* communicating with a fluid passage 38. The inner peripheral suction-holding portions 61 and the outer peripheral suction-holding portions 62 are connected to a vacuum source 121, e.g. a vacuum pump, through the fluid passages 37 and 38 and valves V1 and V2, respectively. When the communicating holes 61*a* and 62*a* of the inner and outer peripheral suction-holding portions 61 and 62 are connected to the vacuum source 121, a negative pressure is formed at an opening end of each of the communicating holes 61*a* and 62*a*, whereby the substrate W to be polished is suction-held to the inner peripheral suction-holding portions 61 and the outer peripheral suction-holding portions 62. It should be noted that elastic sheets 61*b* and 62*b* (see FIG. 2), e.g. thin rubber sheets, are bonded to respective lower ends of the inner and outer peripheral suction-holding portions 61 and 62 to allow the substrate W to be suction-held softly to the inner and outer peripheral suction-holding portions 61 and 62.

In the top ring 1 arranged as stated above as a substrate holding mechanism, when the substrate W is to be transferred, the top ring 1 in its entirety is placed at a transfer position for the substrate W, and the communicating holes 61*a* and 62*a* of the inner and outer peripheral suction-holding portions 61 and 62 are connected to the vacuum source 121 through the fluid passages 37 and 38. The substrate W is suction-held to lower end surfaces of the inner and outer peripheral suction-holding portions 61 and 62 by suction through the communicating holes 61*a* and 62*a*. In this state, the top ring 1 is moved, and the top ring 1 in its entirety is positioned above the polishing table 100. It should be noted that an outer peripheral edge of the substrate W is held by the retainer ring 3 to prevent the substrate W from slipping out of the top ring 1.

When the substrate W is to be polished, a suction hold of the substrate W by the suction-holding portions 61 and 62 is canceled, and the substrate W is held on a lower side of the top ring 1. In addition, the top ring air cylinder 111 coupled to the top ring driving shaft 11 is activated to press the retainer ring 3 secured to the lower end of the top ring 1 against the surface of the polishing pad 101 on the polishing table 100 with a predetermined pressing force. In this state, a fluid pressurized to a predetermined pressure is supplied to each of the pressure chambers 22 to 25 (i.e. the pressure chambers 22 and 23, the central pressure chamber 24, and the intermediate pressure chamber 25) to press the substrate W against the polishing surface of the polishing pad 101. Further, the abrasive liquid Q is supplied from the polishing solution supply nozzle 102. Consequently, the abrasive liquid Q is retained on the polishing pad 101. Thus, polishing is performed in a state where the abrasive liquid Q is present between the polishing pad 101 and a surface (lower surface) to be polished of the substrate W.

Portions of the substrate W that are located under the pressure chambers 22 and 23 are pressed against the surface of the polishing pad 101 with pressure of the pressurized fluid supplied to the pressure chambers 22 and 23. A portion of the substrate W that is located under the central pressure chamber 24 is pressed against the polishing surface with the pressure of the pressurized fluid supplied to the central pressure chamber 24 through the elastic membrane 81 of the central abutting member 8 and the elastic pad 4. A portion of the substrate W that is located under the intermediate pressure chamber 25 is pressed against the polishing surface with pressure of the pressurized fluid supplied to the intermediate pressure chamber 25 through the elastic membrane 91 of the outside abutting member 9 and the elastic pad 4.

Accordingly, the polishing pressure applied to the substrate W being polished can be adjusted for each portion of the substrate W by controlling the pressure of the pressurized fluid supplied to each of the pressure chambers 22 to 25. That is, the pressure of the pressurized fluid supplied to each of the pressure chambers 22 to 25 is adjusted independently of each other by the regulators R3 to R6. Thus, a pressing force with which the substrate W is pressed against the polishing pad 101 on the polishing table 100 is adjusted for each portion of the substrate W.

By controlling the pressure of the pressurized fluid supplied to each of the pressure chambers 22 to 25 independently of each other as stated above, it is possible to press each of four concentric circular and annular divided portions (see regions C1, C2, C3 and C4 in FIG. 3) of the substrate W with an independent pressing force. A polishing rate depends on the pressure with which the substrate W is pressed against the polishing surface. In this regard, because a pressing force applied to each of the four portions of the substrate W can be controlled, it is possible to control a polishing rate at each portion of the substrate W independently of each other.

During polishing of the substrate W, the retainer ring 3 and the substrate W are pressed against the polishing pad 101 on the polishing table 100, thereby causing frictional heat to be generated. The frictional heat causes the substrate holding part of the top ring 1 to be deformed and hence degrades a polishing capability. The frictional heat also raises a surface temperature of the polishing pad 101. Therefore, in this embodiment, a flow passage 26 that is, as shown in FIGS. 1 and 2, surrounded by the housing part 2*a* of the mounting flange 2, the retainer ring 3, the holder ring 5 and the pressurizing sheet 7 is supplied with temperature-controlled air from the air supply source 131 through the switching valve V3, the fluid passage 32, the through-hole 52, the flow passage 51 and the communicating holes 53, thereby effectively cooling the housing part 2*a*, the retainer ring 3 and the holder ring 5 that contact air flowing through the flow passage 26.

Pressure in the flow passage 26 is set equal to or lower than pressure in the pressure chambers 22 to 25. Thus, supply of temperature-controlled air through the flow passage 26 has no influence on the polishing rate of the substrate W.

Further, the temperature-controlled air in the flow passage 26 is sprayed on the polishing surface of the polishing pad 101 on the polishing table 100 through a slight gap G between the outer peripheral surface of the elastic pad 4 and the retainer ring 3 and through a plurality of through-holes 3*a* provided in the retainer ring 3, whereby the polishing surface is effectively cooled. By supplying temperature-controlled moist air from the air supply source 131, it is possible to cool the mounting flange 2 and the retainer ring 3 of the top ring 1 and, at the same time, to prevent drying of surfaces thereof. Consequently, it is possible to prevent the abrasive liquid Q and polishing dust from adhering to and drying on a surface of the mounting flange 2 or the retainer ring 3. It should be noted that the supply of moist air is not necessarily limited to during polishing.

It is also possible to clean the top ring 1 and the polishing surface of the polishing pad 101 on the polishing table 100 by switching the three-way switching valve V3 so as to supply a cleaning liquid from the cleaning liquid supply source 132 through the fluid passage 32, the through-hole 52, the flow passage 51 and the communicating holes 53.

A polyimide compound is used as a constituent material of the retainer ring 3, as stated above. It has been clarified from results of experiments conducted by the inventors of this patent application that use of a polyimide compound as a constituent material of the retainer ring 3 provides more excellent results in terms of a rate of wear of the retainer ring 3, a polishing rate of the substrate to be polished, a surface temperature of the polishing pad, and the like, than in a case of using polyphenylene sulfide (PPS) or polyether ether ketone (PEEK), for example.

Figure 5:
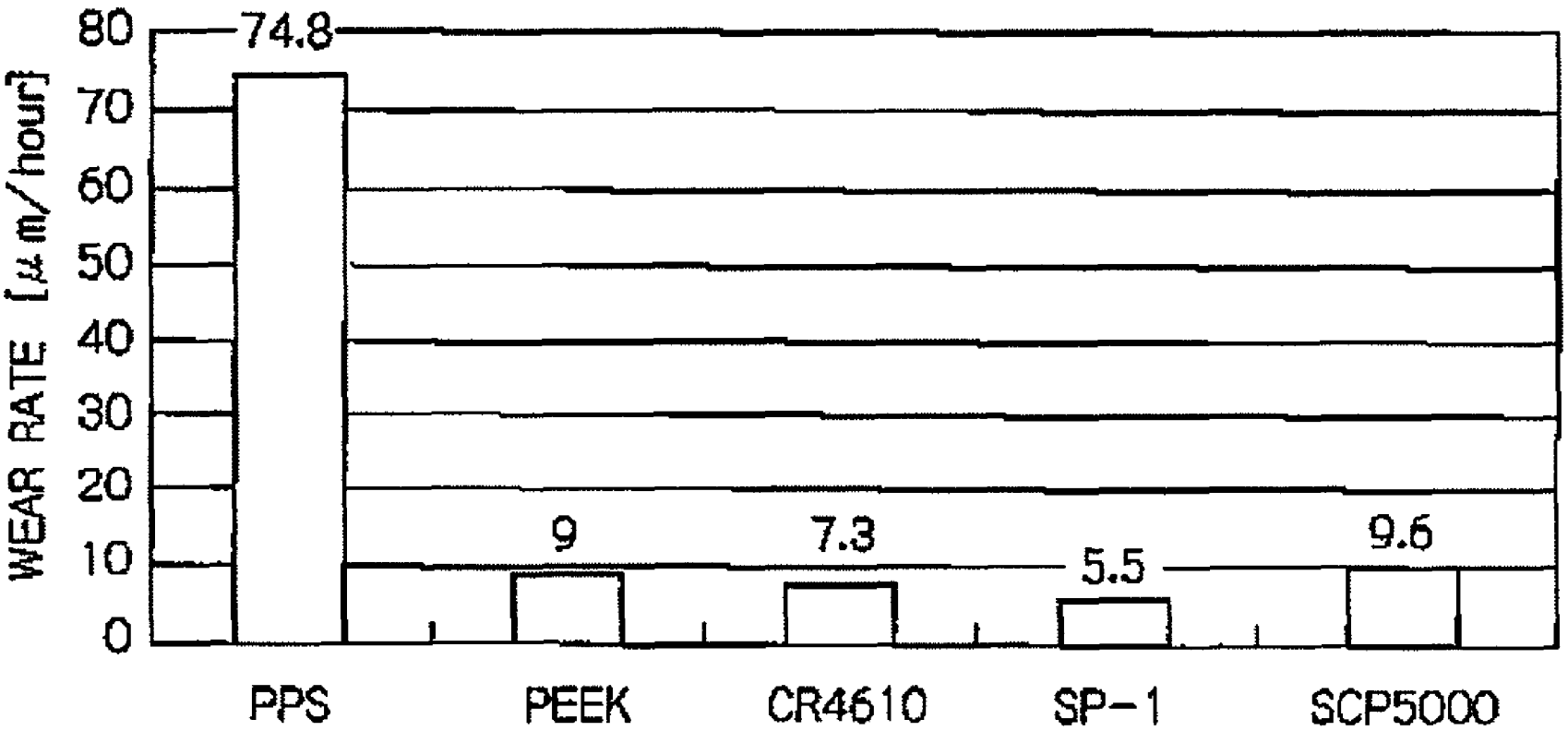
FIG. 5 is a graph showing an example of comparison of a wear rate between various kinds of retainer rings.

FIG. 5 is a graph showing an example of comparison of a wear rate of the retainer ring 3 between various retainer ring materials, i.e. Vespel (registered trademark; CR4610, SP-1, and SCP5000) used as a polyimide compound, polyphenylene sulfide (PPS), and polyether ether ketone (PEEK). It will be understood from the graph that when Vespel (CR4610, SP-1, and SCP5000) is used as a constituent material of the retainer ring 3, the wear rate is lower than in a case of using other materials, particularly polyphenylene sulfide (PPS).

Figure 6:
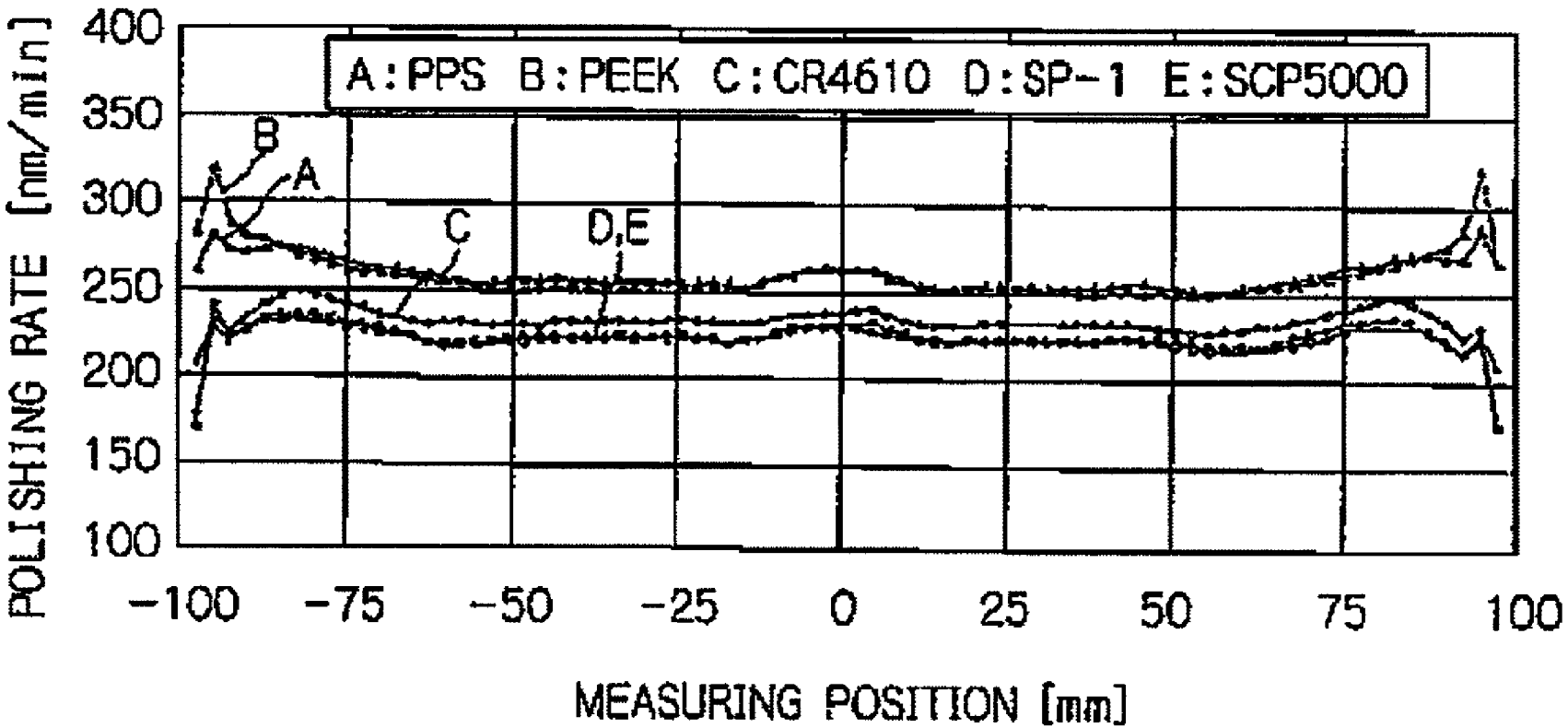
FIG. 6 is a graph showing an example of comparison of a polishing rate between polishing processes using various kinds of retainer rings.

FIG. 6 is a graph showing an example of comparison of a polishing rate of the substrate W between various retainer ring materials, i.e. Vespel (CR4610, SP-1, and SCP5000) used as a polyimide compound, polyphenylene sulfide (PPS), and polyether ether ketone (PEEK). It will be understood from this graph that when Vespel (CR4610, SP-1, and SCP5000) is used as a constituent material of the retainer ring 3, the polishing rate at an edge portion of the substrate W is suppressed, whereas when polyphenylene sulfide (PPS) or polyether ether ketone (PEEK) is used, the polishing rate at the edge portion of the substrate W increases unfavorably, thereby resulting in a drooping of the edge of the substrate W.

Figure 7:
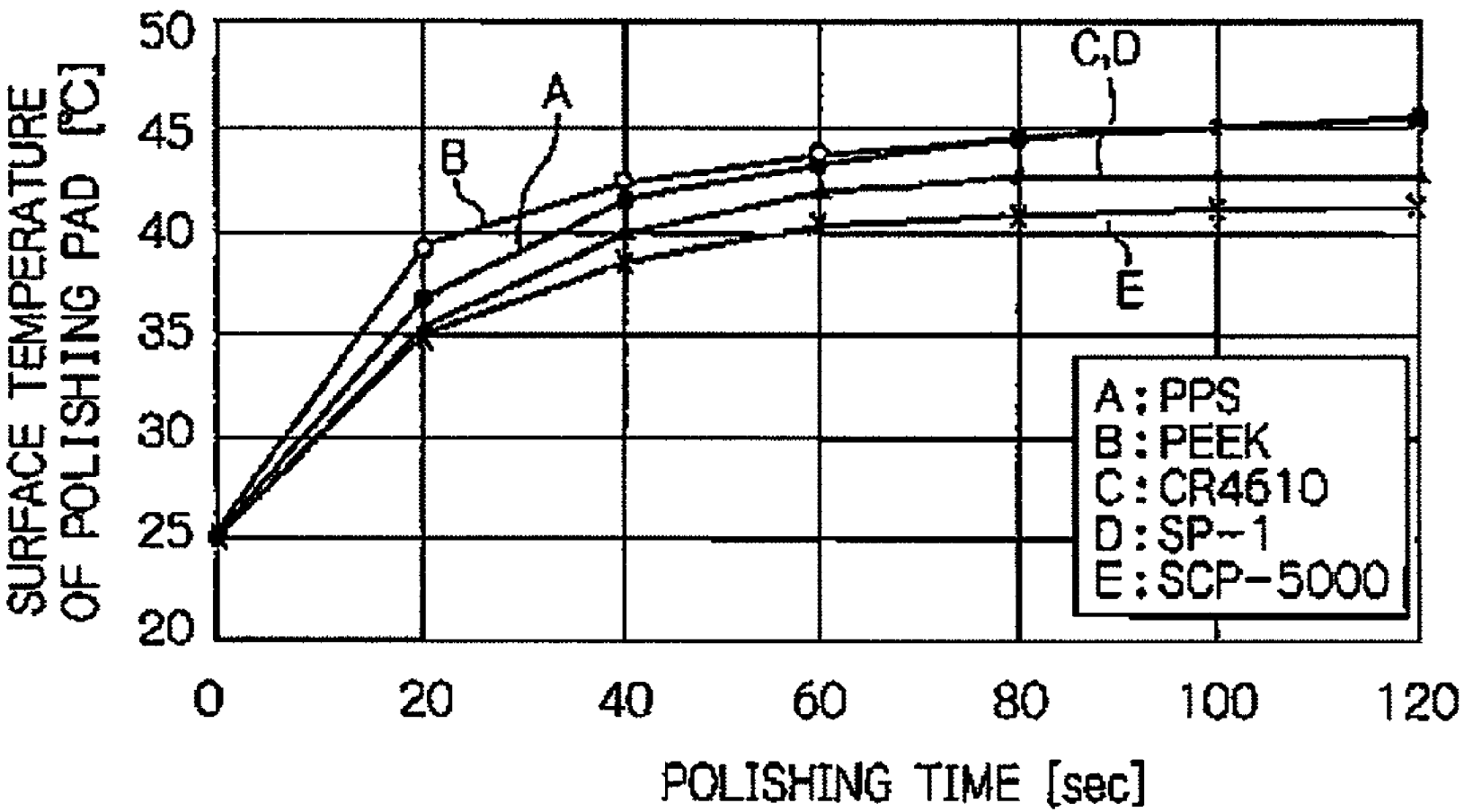
FIG. 7 is a graph showing an example of comparison of a polishing surface temperature change between polishing tables using various kinds of retainer rings.

FIG. 7 is a graph showing an example of comparison of a rise in temperature of the polishing surface of the polishing pad with passage of polishing time between various retainer ring materials, i.e. Vespel (CR4610, SP-1, and SCP5000) used as a polyimide compound, polyphenylene sulfide (PPS), and polyether ether ketone (PEEK). It will be understood from this graph that when Vespel (CR4610, SP-1, and SCP5000) is used as a constituent material of the retainer ring 3, a surface temperature of the polishing pad is lower than in a case of using polyphenylene sulfide (PPS) or polyether ether ketone (PEEK).

It should be noted that the top ring arranged as stated above as a substrate holding mechanism is merely an example, and the substrate holding mechanism according to the present invention is not necessarily limited thereto. It is essential only that the substrate holding mechanism have a mounting flange, a support member secured to the mounting flange, and a retainer ring secured to the mounting flange to hold a substrate to be polished on a lower side of the support member surrounded by the retainer ring and to press the substrate against a polishing surface. The specific arrangement of the substrate holding mechanism does not matter.

The substrate polishing apparatus is also not necessarily limited to the one having the above-described arrangement. It is essential only that the substrate polishing apparatus have a substrate holding mechanism and a polishing table with a polishing surface, and be arranged such that a substrate to be polished that is held by the substrate holding mechanism is pressed against the polishing surface of the polishing table, and the substrate is polished by relative movement between the substrate held by the substrate holding mechanism and the polishing surface of the polishing table. The specific arrangement of the substrate polishing apparatus does not matter.

Figure 8:
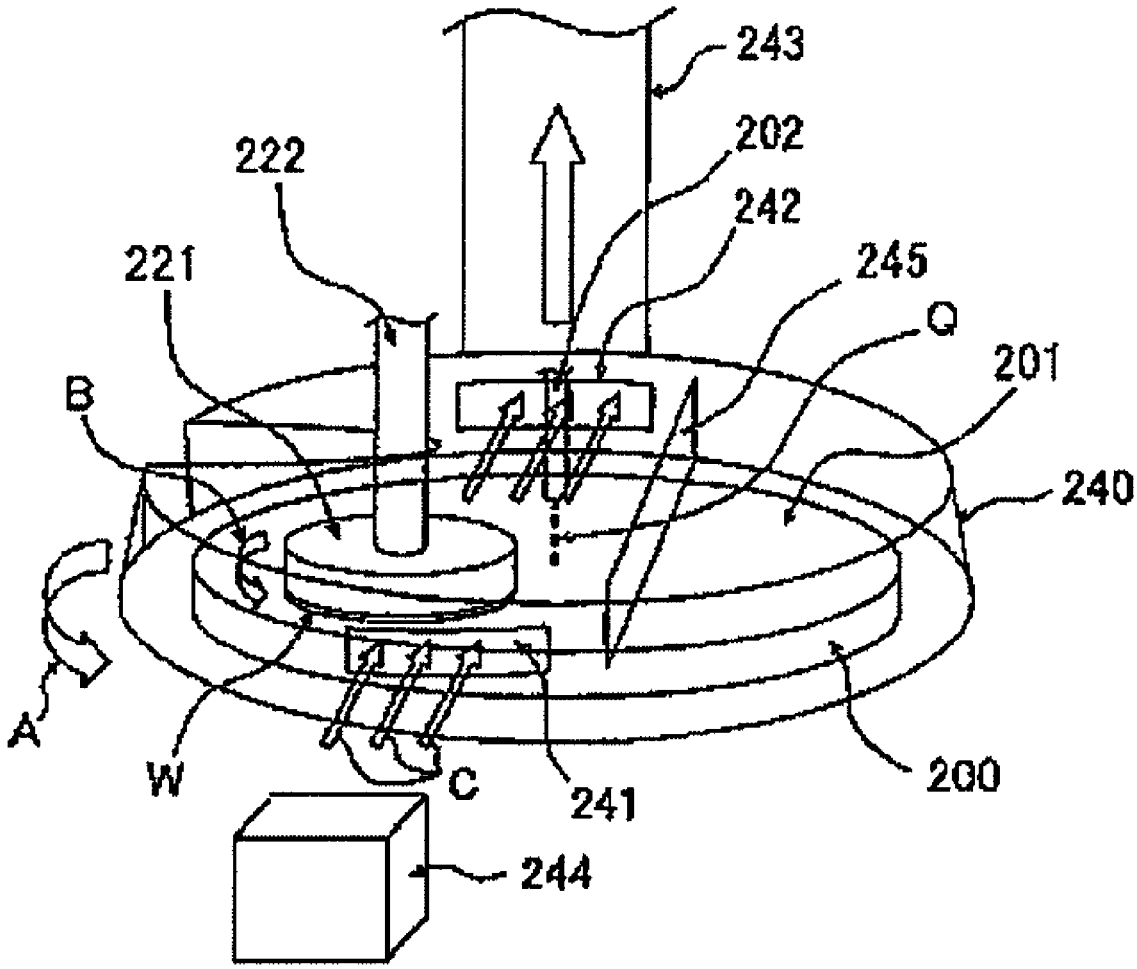
FIG. 8 is a schematic view showing a structural example of the substrate polishing apparatus according to the present invention.

FIG. 8 is a schematic view showing a structural example of the substrate polishing apparatus according to the present invention. In FIG. 8, a polishing table 200 performs rotation in a direction of arrow A as one planar motion. The polishing table 200 is a table made of a flat rigid material, which has a polishing pad 201 bonded to a top thereof. A top ring 221 has a substrate W to be polished, e.g. a semiconductor substrate, held on a lower side thereof. The top ring 221 is driven to rotate in a direction of arrow B by a top ring driving shaft 222. While rotating, the top ring 221 presses the substrate W held on the lower side thereof against an upper surface of the polishing pad 201 on the polishing table 200 (i.e. the top ring 221 brings the substrate W into contact with the upper surface of the polishing pad 201 under pressure). In addition, an abrasive liquid Q is quantitatively supplied (dropped) from a polishing solution supply nozzle 202 onto the upper surface of the polishing pad 201 and fed between the upper surface of the polishing pad 201 and a lower surface (surface to be polished) of the substrate W.

A dome 240 covering the polishing pad 201 and the top ring 221 is provided with an inlet port 241 and an outlet port 242. The outlet port 242 is connected to an outlet duct 243. When an evacuating device in the dome 240 is activated, a gas stream is induced from the inlet port 241 toward the outlet port 242 as shown by arrows C to cool the polishing pad 201 and the top ring 221, which are located in a flow path of the gas stream. A low-temperature gas supply device 244 supplies a low-temperature gas, e.g. low-temperature air or other gas. In a case where cooling of the polishing pad 201 and the top ring 221 by the gas stream induced by this evacuation is insufficient, the low-temperature gas is supplied from the inlet port 241 to assist in cooling.

A partition plate 245 is provided in the dome 240. During a time when the substrate W held by the rotating top ring 221 is pressed against the polishing pad 201 on rotating polishing table 200 to thereby polish the substrate W as stated above, the partition plate 245 controls a gas stream so that the top ring 221, which is a heat generation source, and a surface of a portion of the polishing pad 201 in the neighborhood of the top ring 221 are placed within a flow path of the gas stream.

According to the above-described substrate polishing apparatus, the surface of the polishing pad 201 and the top ring 221 are cooled by a method wherein direct gas cooling is performed from above the polishing pad 201, or cooling is effected by auxiliary cooling with a low-temperature gas from the low-temperature gas supply device 244 in addition to the direct gas cooling. Therefore, the surface of the polishing pad 201 and the top ring 221 can be effectively cooled without adding a substantial change to a system configuration of existing substrate polishing apparatus, but simply by adding thereto the dome 240 having the inlet port 241 and the outlet port 242, the outlet duct 243, the partition plate 245, and the evacuating device, or the low-temperature gas supply device 244, in addition thereto.

Figure 9:
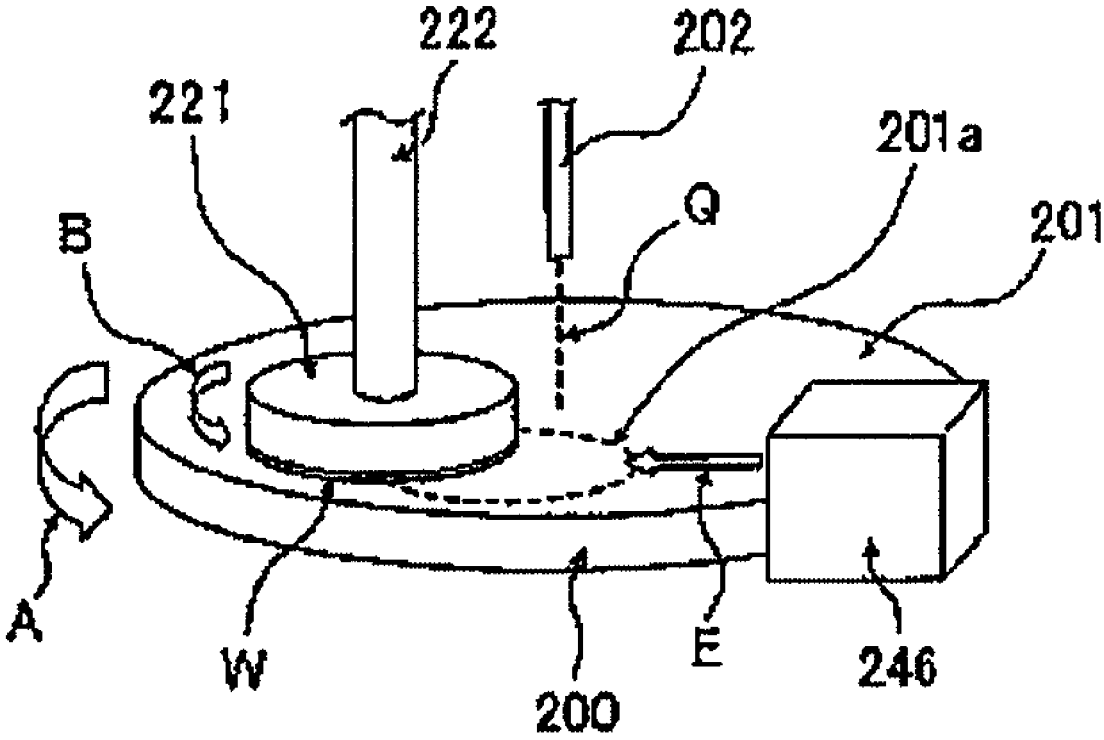
FIG. 9 is a schematic view showing a structural example of the substrate polishing apparatus according to the present invention.

FIG. 9 is a schematic view showing a structural example of the substrate polishing apparatus according to the present invention. The substrate polishing apparatus shown in FIG. 9 is the same as that shown in FIG. 8 in the following features: The apparatus has a polishing table 200 made of a flat rigid material and rotating in direction of arrow A, a top ring 221 rotating in direction of arrow B, and a polishing solution supply nozzle 202 that quantitatively supplies an abrasive liquid Q onto an upper surface of the polishing pad 201. Substrate W held on a lower side of the top ring 221 rotating in the direction of arrow B is pressed against the upper surface of the polishing pad 201 on the polishing table 200 rotating in the direction of arrow A while the abrasive liquid Q is being quantitatively supplied onto the upper surface of the polishing pad 201 from the polishing solution supply nozzle 202, thereby polishing the substrate W.

The substrate polishing apparatus shown in FIG. 9 has a pad surface cooling device 246 for cooling the upper surface of the polishing pad 201. Examples of devices usable as the pad surface cooling device 246 are a room-temperature gas supply device, e.g. a blast fan, which supplies room-temperature air or a room-temperature gas, and a low-temperature gas supply device that supplies low-temperature air or a low-temperature gas.

According to the above-described substrate polishing apparatus, the upper surface of the polishing pad 201 and the top ring 221 are cooled by a method wherein a room-temperature gas or a low-temperature gas is supplied from the pad surface cooling device 246 to perform direct cooling from above the polishing pad 201. Therefore, the upper surface of the polishing pad 201 and the top ring 221 can be effectively cooled without substantially changing a system configuration of existing substrate polishing apparatus (structure), but simply by adding the pad surface cooling device 246 to this conventional structure.

Figure 10:
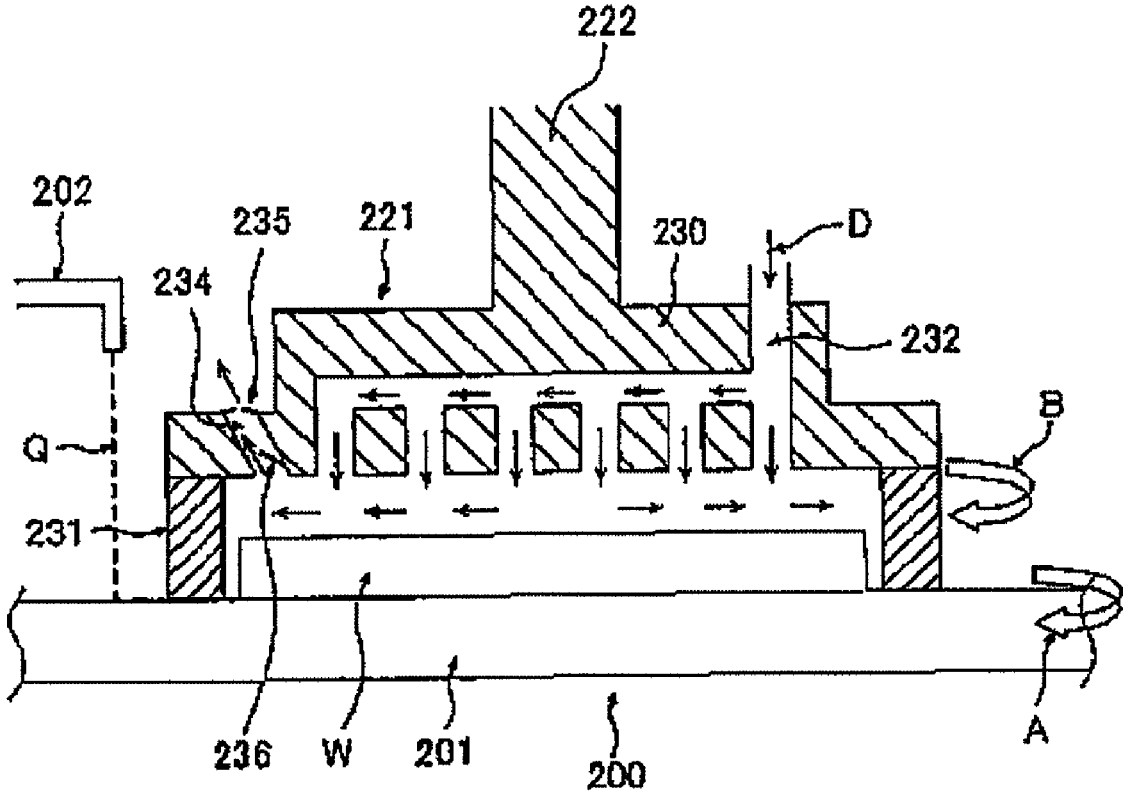
FIG. 10 is a schematic sectional view showing a structural example of the substrate polishing apparatus according to the present invention.

FIG. 10 is a schematic view showing a structural example of the substrate polishing apparatus according to the present invention. The substrate polishing apparatus shown in FIG. 10 is the same as those shown in FIGS. 8 and 9 in the following features: The apparatus has a polishing table 200 made of a flat rigid material and rotating in direction of arrow A, a top ring 221 rotating in direction of arrow B, and a polishing solution supply nozzle 202 that quantitatively supplies an abrasive liquid Q onto an upper surface of the polishing pad 201. Substrate W held on a lower side of the top ring 221 rotating in the direction of arrow B is pressed against the upper surface of the polishing pad 201 on the polishing table 200 rotating in the direction of arrow A while the abrasive liquid Q is being quantitatively supplied onto the upper surface of the polishing pad 201 from the polishing solution supply nozzle 202, thereby polishing the substrate W.

The top ring 221 has an approximately disk-shaped top ring body 230. A substrate guide 231 is secured to an outer periphery of a lower side of the top ring body 230 to prevent the substrate W from slipping out from the lower side of the top ring body 230. The top ring body 230 is provided therein with a low-temperature gas flow passage 232 for supplying a low-temperature gas D, e.g. a low-temperature gas or low-temperature air, to a reverse side of the substrate W (a surface to be polished of the substrate W is assumed to be an obverse side). A distal end of the low-temperature gas flow passage 232 opens to the reverse side of the substrate W. The low-temperature gas D is also supplied to the upper surface of the polishing pad 201 through a slight gap between the substrate W and the substrate guide 231. The top ring body 230 is provided with a low-temperature gas discharge passage 234 for discharging the low-temperature gas D.

The low-temperature gas discharge passage 234 is provided with an opening-adjustable fixed flow control valve 235 to supply the low-temperature gas D at a constant flow rate so that the low-temperature gas D will not stagnate at the reverse side of the substrate W during polishing of the substrate W. The opening-adjustable fixed flow control valve 235 also controls a flow velocity of the low-temperature gas D at the reverse side of the substrate W. In addition, a check valve 236 is provided in the low-temperature gas discharge passage 234 to prevent gas from flowing backward from the low-temperature gas discharge passage 234 when the substrate W is suction-held to the lower side of the top ring body 230 by action of a negative pressure produced by sucking the low-temperature gas D from the low-temperature gas flow passage 232 by operation of an evacuating device.

As stated above, the substrate polishing apparatus cools the upper surface of the polishing pad 201 and the top ring 221 by directly supplying the low-temperature gas D to the reverse side of the substrate W. Therefore, the substrate W can be effectively cooled.

A method of polishing the substrate W by using the substrate polishing apparatus arranged as shown in FIG. 8 will be described below in detail. While the abrasive liquid Q containing abrasive particles is being quantitatively supplied from the polishing solution supply nozzle 202 onto the upper surface of the polishing pad 201 on the rotating polishing table 200, the substrate W held by the rotating top ring 221 is pressed against the upper surface of the polishing pad 201, thereby polishing the surface of the substrate W. At this time, an interior of the dome 240 covering the polishing pad 201 and the top ring 221 is locally evacuated to induce a gas stream from the inlet port 241 toward the outlet port 242 and the outlet duct 243. The gas stream is positively controlled with the partition plate 245 so that the polishing pad 201 and the top ring 221 are placed within a flow path of the gas stream, thereby enabling a surface temperature of the polishing pad 201 and a temperature of the substrate W to be maintained in a range of from 40° C. to 65° C. during polishing of the substrate W.

In particular, a portion of the upper surface of the polishing pad 201 at a side thereof (at a side of the polishing table 200) where the polishing pad 201 moves relative to the substrate W generates a large amount of frictional heat because of a large amount of relative movement between the polishing pad 201 and the substrate W. Therefore, the gas stream is controlled with the partition plate 245 so that a neighborhood of this portion of the polishing pad 201 is placed within the flow path of the gas stream. By doing so, the surface temperature of the polishing pad 201 and the temperature of the substrate W can be maintained in the range of from 40° C. to 65° C.

A method of polishing the substrate W by using the substrate polishing apparatus arranged as shown in FIG. 9 will be described below in detail. While the abrasive liquid Q containing abrasive particles is being quantitatively supplied from the polishing solution supply nozzle 202 onto the upper surface of the polishing pad 201 on the rotating polishing table 200, the substrate W held by the rotating top ring 221 is pressed against the upper surface of the polishing pad 201, thereby polishing the surface of the substrate W. At this time, a room-temperature gas or low-temperature gas E is supplied to a cooling spot 201*a*on the polishing pad 201 from the pad surface cooling device 246 installed near the top ring 221, thereby enabling a surface temperature of the polishing pad 201 and a temperature of the substrate W to be maintained in a range of from 40° C. to 65° C. As can be seen from FIG.9, the cooling spot 201*a*includes an area on the polishing surface that is immediately downstream of the substrate holding mechanism 221 and the wafer W with respect to the direction of rotation A during polishing.

In particular, a portion of the upper surface of the polishing pad 201 at a side thereof (at a side of the polishing table 200) where the polishing pad 201 moves relative to the substrate W generates a large amount of frictional heat because of a large amount of relative movement between the polishing pad 201 and the substrate W as stated above. Therefore, by supplying a room-temperature gas or low-temperature gas from the pad surface cooling device 246 to the cooling spot 201*a*in the neighborhood of the above-described portion of the polishing pad 201, the surface temperature of the polishing pad 201 and the temperature of the substrate W can be maintained in the range of from 40° C. to 65° C. As can be appreciated from the arrangement of FIG. 9 in the above description, the amount of the room-temperature air or low-temperature air that is supplied to the cooling spot 201*a* is greater than that supplied to an area on the surface of the polishing pad 201 other than the cooling spot 201*a*.

A method of polishing the substrate W by using the substrate polishing apparatus arranged as shown in FIG. 10 will be described below in detail. While the abrasive liquid Q containing abrasive particles is being quantitatively supplied from the polishing solution supply nozzle 202 onto the upper surface of the polishing pad 201 on the rotating polishing table 200, the substrate W held by the rotating top ring 221 is pressed against the upper surface of the polishing pad 201, thereby polishing the surface of the substrate W. At this time, the low-temperature gas D is continuously supplied to the reverse side of the substrate W, and an approximately constant flow velocity of the low-temperature gas D is ensured by the opening-adjustable fixed flow control valve 235 so that the low-temperature gas D supplied to the reverse side of the substrate W will not stagnate at the reverse side of the substrate W. Further, the flow velocity of the low-temperature gas D is controlled by adjusting an opening of the opening-adjustable fixed flow control valve 235. Thus, a surface temperature of the polishing pad 201 and a temperature of the substrate W can be maintained in a range of from 40° C. to 65° C. during polishing of the substrate W.

To transfer the substrate W after polishing, the low-temperature gas D in the low-temperature gas flow passage 232 is sucked by the evacuating device to produce a negative pressure, thereby allowing the substrate W to be held to the lower side of the top ring body 230. Because the check valve 236 is provided in the low-temperature gas discharge passage 234, the gas will not flow backward to the reverse side of the substrate W. Therefore, the substrate W can be surely suction-held to the lower side of the top ring body 230.

Figure 11:
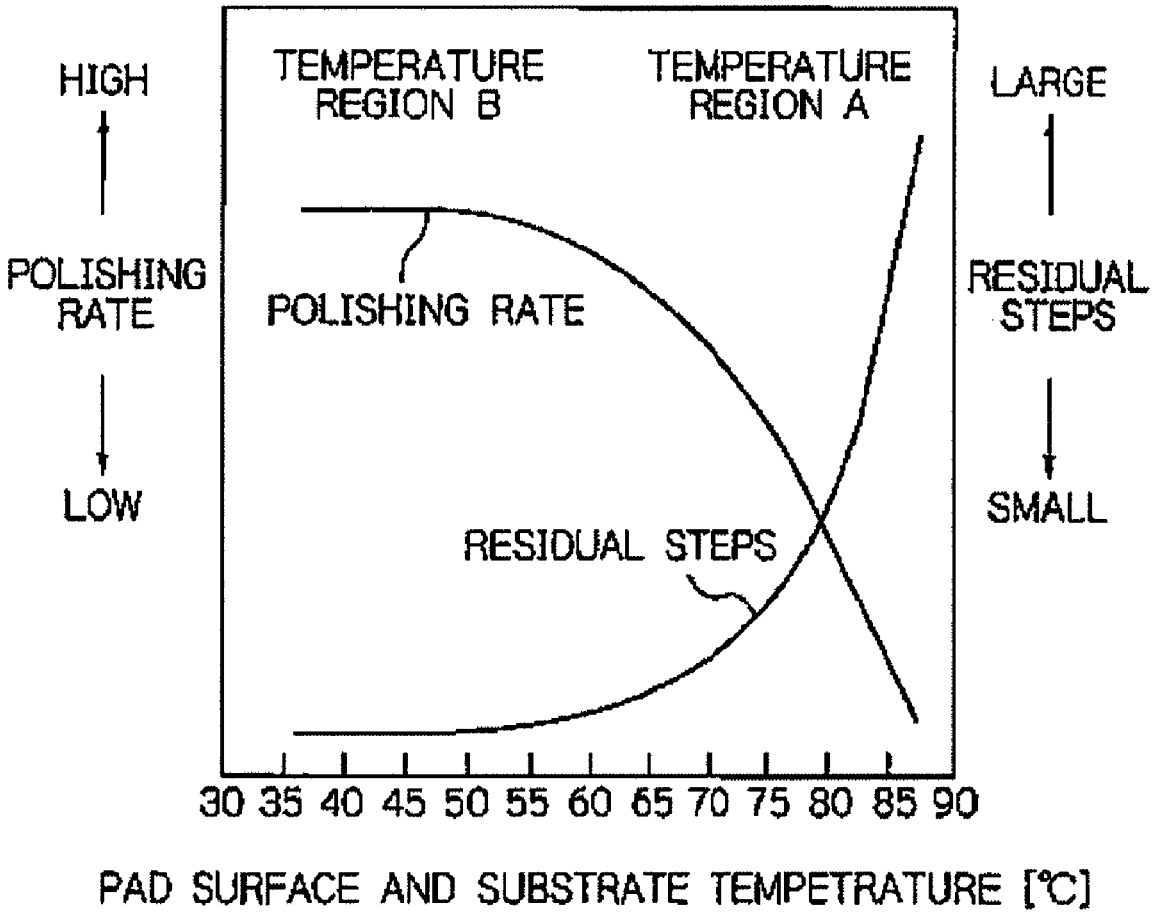
FIG. 11 is a graph showing an example of comparison between a conventional substrate polishing process and a substrate polishing process according to the present invention.

FIG. 11 is a graph showing an example of comparison between substrate polishing performed by using a conventional substrate polishing apparatus and substrate polishing performed by using the substrate polishing apparatus according to the present invention. In FIG. 11, the abscissa axis represents a polishing pad surface temperature (° C.) and substrate temperature (° C.) during polishing. The left-hand ordinate axis represents a polishing rate, and the right-hand ordinate axis represents residual steps, which are left on a polished substrate surface. It should be noted that the abrasive liquid used in the substrate polishing process is an abrasive liquid having a high-molecular surface active agent as a principal component. As shown in FIG. 11, in a polishing process performed with the conventional substrate polishing apparatus, in which the polishing pad surface temperature and the substrate temperature are in a temperature region A (at least 65° C.), as the temperature rises, the polishing rate lowers, and residual steps increase in size. In a polishing process performed with the substrate polishing apparatus according to the present invention, in which the polishing pad surface temperature and the substrate temperature are in a temperature region B (40° C. to 65° C.), a high polishing rate can be obtained, and residual steps are favorably small in size.

Figure 12:
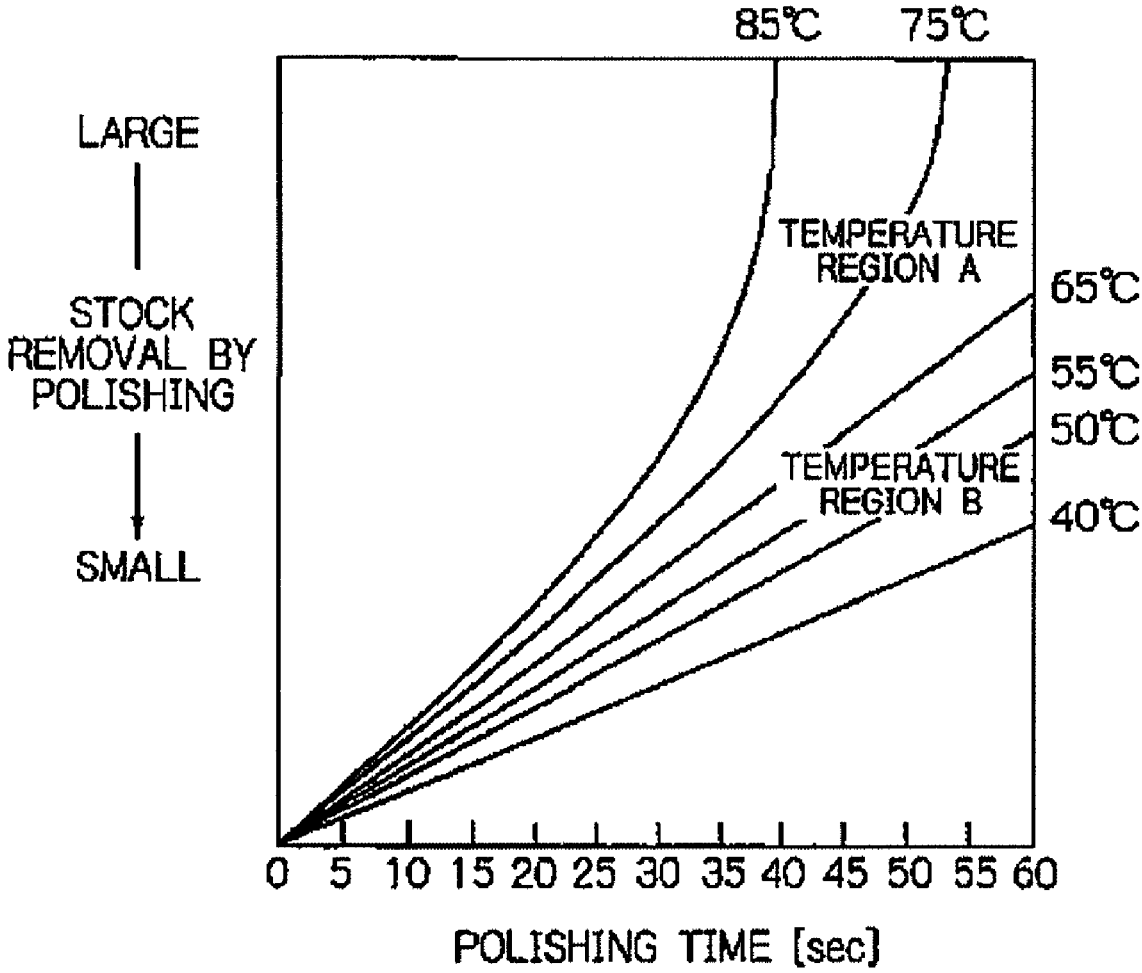
FIG. 12 is a graph showing an example of comparison between a conventional substrate polishing process and a substrate polishing process according to the present invention.

FIG. 12 is a graph showing an example of comparison between conventional substrate polishing and substrate polishing according to the present invention in a polishing method wherein a substrate having a thin film of wiring material formed over a substrate surface, including recesses for wiring formed in the substrate surface, is polished to remove the wiring material exclusive of that in the recesses of the substrate. In FIG. 12, the abscissa axis represents polishing time (sec) during polishing, and the ordinate axis represents stock removal by polishing. As shown in FIG. 12, in a polishing process performed with the conventional substrate polishing apparatus, in which the polishing pad surface temperature and the substrate temperature are in a temperature region A, the polishing time and the stock removal are not in a proportional relationship, but the stock removal increases exponentially with passage of polishing time. In contrast, a polishing process performed with the substrate polishing apparatus according to the present invention, in which the polishing pad surface temperature and the substrate temperature are in a temperature region B, shows that the polishing time and the stock removal are in a proportional relationship.

Accordingly, to obtain a desired stock removal, it is difficult with the conventional temperature region to perform stock removal control based on the polishing time or stock removal control using a polishing end point detecting device. In addition, the conventional polishing process is inferior in terms of reproducibility. In the polishing process performed with the substrate polishing apparatus according to the present invention, in which the polishing pad surface temperature and the substrate temperature are in temperature region B (40° C. to 65° C.), the polishing time and the stock removal are in a proportional relationship. Therefore, to obtain a desired stock removal, it is easy to perform stock removal control based on the polishing time and also easy to perform stock removal control using a polishing end point detecting device. In addition, excellent reproducibility can be obtained.

As stated above, the surface temperature of the polishing pad and the temperature of the substrate should preferably be kept in the range of from 40° C. to 65° C. during polishing, particularly preferably in the range of from 45° C. to 60° C., in a polishing method wherein peaks and valleys of a material layer formed on a substrate surface are made flat by polishing, and also in a polishing method wherein a wiring material formed over a substrate, including recesses formed therein, is removed by polishing, exclusive of the wiring material in the recesses.

As has been stated above, the present invention is capable of efficiently controlling a temperature of the retainer ring, the polishing surface and the substrate holding mechanism, and hence capable of improving polishing performance in terms of polishing rate, polishing uniformity, and the like.

The invention claimed is:

1. A method of polishing a substrate to be polished, said method comprising:

polishing the substrate by holding the substrate with a substrate holding mechanism and pressing the substrate against a polishing surface of a polishing pad that is on a rotating polishing table; and supplying room-temperature air or low-temperature air directly to a cooling spot on the polishing surface from a pad surface cooling device that is installed near the substrate holding mechanism so that a temperature of the polishing surface is maintained in a predetermined range during said polishing;

wherein a portion of the polishing surface on one side of the polishing table has frictional heat generated by relative movement between the substrate and the polishing surface during said polishing;

wherein said cooling spot is in the neighborhood of the portion of the polishing surface;

wherein said polishing comprises rotating the polishing table in a direction of rotation and wherein the cooling spot includes an area that is immediately downstream of the substrate holding mechanism with respect to the direction of rotation; and wherein an amount of the room-temperature air or low-temperature air supplied to the cooling spot is greater than that supplied to an area on the polishing surface other than the cooling spot.

2. The method of claim 1, further comprising:

covering the polishing surface and a substrate holding part of the substrate holding mechanism with a dome having an inlet port and an outlet port; and inducing a gas stream from the inlet port toward the outlet port by locally evacuating an inside of the dome to cool the polishing surface and the substrate holding part with a low-temperature gas supplied from a low-temperature gas supply.

3. The method of claim 1, further comprising:

supplying a low-temperature gas to a reverse side of the substrate being polished from a low-temperature gas supply to cool the substrate.

4. The method of claim 1, wherein the substrate has a thin film of wiring material formed over a primary layer that includes recesses therein, and said polishing removes the wiring material exclusive of the wiring material in the recesses.

5. The method of claim 1, wherein the pad surface cooling device comprises a blast fan.

6. A method of polishing a substrate to be polished, said method comprising:

polishing the substrate by holding the substrate with a substrate holding mechanism and pressing the substrate against a polishing surface of a polishing pad that is on a rotating polishing table; and supplying room-temperature air or low-temperature air directly to a cooling spot on the polishing surface from a pad surface cooling device that is located adjacent to the polishing table so that a temperature of the polishing surface is maintained in a predetermined range during said polishing;

wherein the polishing surface has frictional heat generated by relative movement between the substrate and the polishing surface during said polishing; and wherein said polishing comprises rotating the polishing table in a direction of rotation and wherein the cooling spot is an area immediately downstream of the substrate holding mechanism with respect to the direction of rotation; and wherein an amount of the room-temperature air or low-temperature air supplied to the cooling spot is greater than that supplied to an area on the polishing surface other than the cooling spot.

7. The method of claim 6, further comprising:

covering the polishing surface and a substrate holding part of the substrate holding mechanism with a dome having an inlet port and an outlet port; and inducing a gas stream from the inlet port toward the outlet port by locally evacuating an inside of the dome to cool the polishing surface and the substrate holding part with a low-temperature gas supplied from a low-temperature gas supply.

8. The method of claim 6, further comprising:

supplying a low-temperature gas to a reverse side of the substrate being polished from a low-temperature gas supply to cool the substrate.

9. The method of claim 6, wherein the substrate has a thin film of wiring material formed over a primary layer that includes recesses therein, and said polishing removes the wiring material exclusive of the wiring material in the recesses.

10. The method of claim 6, wherein the pad surface cooling device comprises a blast fan.

11. The method of claim 6, wherein the predetermined range is 40-65 degrees C.

12. The method of claim 1, wherein the cooling spot is an area of the polishing surface that is smaller than the entirety of the polishing surface.

13. The method of claim 1, wherein the cooling spot is an area of the portion of the polishing surface that is located between the substrate holding mechanism and the cooling device, and the cooling spot is an area smaller than both of the area of the polishing surface and the area of the portion of the polishing surface.

* * * * *